US009545560B2

(12) United States Patent
Chen et al.

(10) Patent No.: US 9,545,560 B2
(45) Date of Patent: Jan. 17, 2017

(54) HEEL LOCKING BINDING SYSTEM

(71) Applicant: HELOS, LLC, Phoenix, AZ (US)

(72) Inventors: Chieh-an Chen, Tempe, AZ (US); Rebecca Christensen, Phoenix, AZ (US); Gilwon Kim, Tempe, AZ (US); Leila Jawhar, Tempe, AZ (US); Michael Heeb, Glendale, AZ (US); Jeffrey McNeill, Tempe, AZ (US)

(73) Assignee: HELOS, LLC, Phoenix, AZ (US)

( * ) Notice: Subject to any disclaimer, the term of this patent is extended or adjusted under 35 U.S.C. 154(b) by 0 days.

(21) Appl. No.: 14/976,965

(22) Filed: Dec. 21, 2015

(65) Prior Publication Data

US 2016/0175689 A1 Jun. 23, 2016

Related U.S. Application Data

(60) Provisional application No. 62/095,644, filed on Dec. 22, 2014, provisional application No. 62/112,020, filed on Feb. 4, 2015.

(51) Int. Cl.

| | |
|---|---|
| ***A63C 10/24*** | (2012.01) |
| ***A63C 10/28*** | (2012.01) |
| ***B63B 35/81*** | (2006.01) |
| *A63C 10/06* | (2012.01) |

(52) U.S. Cl.

CPC ..... *A63C 10/24* (2013.01); *A63C 10/28* (2013.01); *B63B 35/812* (2013.01); *A63C 10/06* (2013.01)

(58) Field of Classification Search

CPC ..... A63C 10/04; A63C 10/08; A63C 10/24; A63C 10/28; A63C 10/06; A63C 10/10; A63C 10/14

See application file for complete search history.

(56) References Cited

U.S. PATENT DOCUMENTS

| | | | | |
|---|---|---|---|---|
| 8,960,710 | B2 | 2/2015 | Pascal | |
| 9,132,336 | B2 | 9/2015 | Bulan | |
| 9,149,711 | B1 | 10/2015 | Kavarsky et al. | |
| 2006/0244241 | A1 * | 11/2006 | Martin | A63C 10/04 280/619 |

FOREIGN PATENT DOCUMENTS

WO WO 2014/089622 6/2014

OTHER PUBLICATIONS

Strewth Snowboarding, "Strewth SLS Bindings—Dec. 2016 PreOrder," http://web.archive.org/web/20160326092522/http://strewthsnowboarding.com/products/strewth-sis-bindings as archived Mar. 26, 2016 in 2 pages.

(Continued)

*Primary Examiner* — Erez Gurari

(74) *Attorney, Agent, or Firm* — Knobbe, Martens, Olson & Bear, LLP

(57) ABSTRACT

The disclosure herein provides methods, systems, and devices for hands-free binding that offer enhanced convenience, style, and performance. In an embodiment, the systems and devices disclosed herein comprise a binding system having an opening. In an embodiment, the binding system can be configured to change the size of the opening to allow for an item to be inserted, secured, released, and/or removed. In an embodiment, the binding system can be configured to be able to change its profile.

17 Claims, 27 Drawing Sheets

(56) References Cited

OTHER PUBLICATIONS

Strewth Snowboarding, "Strewth Snowboards Launches New Take on Step-in Bindings," Posted Jan. 17, 2016, http://web.archive.org/web/20160404164059/http://strewthsnowboarding.com/blogs/strewth-snowboards-launches-new-take-on-step-in-bindings/85739651-strewth-snowboards-launches-new-take-on-step-in-bindings as archived Apr. 4, 2016 in 3 pages.
Strewth Snowboarding, http://web.archive.org/web/20160404163739/http://strewthsnowboarding.com/ as archived Apr. 4, 2016 in 7 pages.

* cited by examiner

HEEL LOCKING BINDING SYSTEM

CROSS-REFERENCE TO RELATED APPLICATIONS

The present application claims the benefit under 35 U.S.C. 119(e) to U.S. Provisional Application No. 62/095,644, filed Dec. 22, 2014 and titled HEEL LOCKING BINDING SYSTEM. The present application claims the benefit under 35 U.S.C. 119(e) to U.S. Provisional Application No. 62/112,020, filed Feb. 4, 2015 and titled HEEL LOCKING BINDING SYSTEM. The foregoing applications are hereby incorporated herein by reference in their entirety, including specifically but not limited to the heel locking binding systems.

BACKGROUND

Field

Embodiments relate to hands-free binding technology and are applicable to any system in which a binding may be used, including the field of snowboarding technology.

Description of the Related Art

Various bindings have been, developed in the snowboard technology field to connect a rider's boots to a user's board. These bindings generally remain attached to the board during normal use. Typically, riders connect and disconnect their boots from their bindings frequently during normal use. For example, riders generally disconnect at least one binding in order to board a chair lift, and reconnect the binding after getting off the lift to start their next run.

SUMMARY

For purposes of this summary, certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

Various embodiments of the present invention relate to hands-free binding technology, which generally refers to securing and releasing items without the use of hands or with reduced use of hands. This disclosure provides embodiments addressing the following shortcomings of conventional bindings: manual tightening, the need for specific boots, increased distance between the boot and the surface of the board, presence of a mechanism between the boot and the board, and the need to reduce the binding profile size for storage or transport. In an embodiment, the systems and devices disclosed herein comprise a binding system that can be configured to change the size of an opening to allow for an item to be inserted, secured, released, and/or removed. In an embodiment, the binding system can be configured to be able to have a changeable profile.

In an embodiment, a binding system comprises a base plate, a highback, and a heel strap; wherein the base plate and highback are able to move relative to one another; wherein an opening is formed between the base plate, highback, and heel strap; and wherein the relative movement between the base plate and highback changes the size of the opening.

In an embodiment, a binding system comprises a base plate, a highback, and a heel, strap; wherein the base plate and heel strap are able to move relative to one another; wherein an opening is formed between the base plate, highback, and heel strap; and wherein the relative movement between the base plate and heel strap changes the size of the opening.

In an embodiment, a binding system comprises a base plate, a highback, and a heel strap; wherein the base plate, highback, and heel strap are able to move relative to one another; wherein an opening is formed between the base plate, highback, and heel strap; and wherein the relative movement between the base plate, highback, and heel strap changes the size of the opening.

In an embodiment, a binding system comprises a base plate, a highback first portion, and a highback second portion; wherein the highback first portion and the highback second portion are able to move relative to one another.

BRIEF DESCRIPTION OF THE DRAWINGS

The foregoing and other features, aspects and advantages are illustrated in detail below with reference to the drawings of various embodiments, which are intended to illustrate and not to limit the disclosure. The drawings comprise the following figures in which.

DETAILED DESCRIPTION OF THE EMBODIMENTS

Figure 1A:
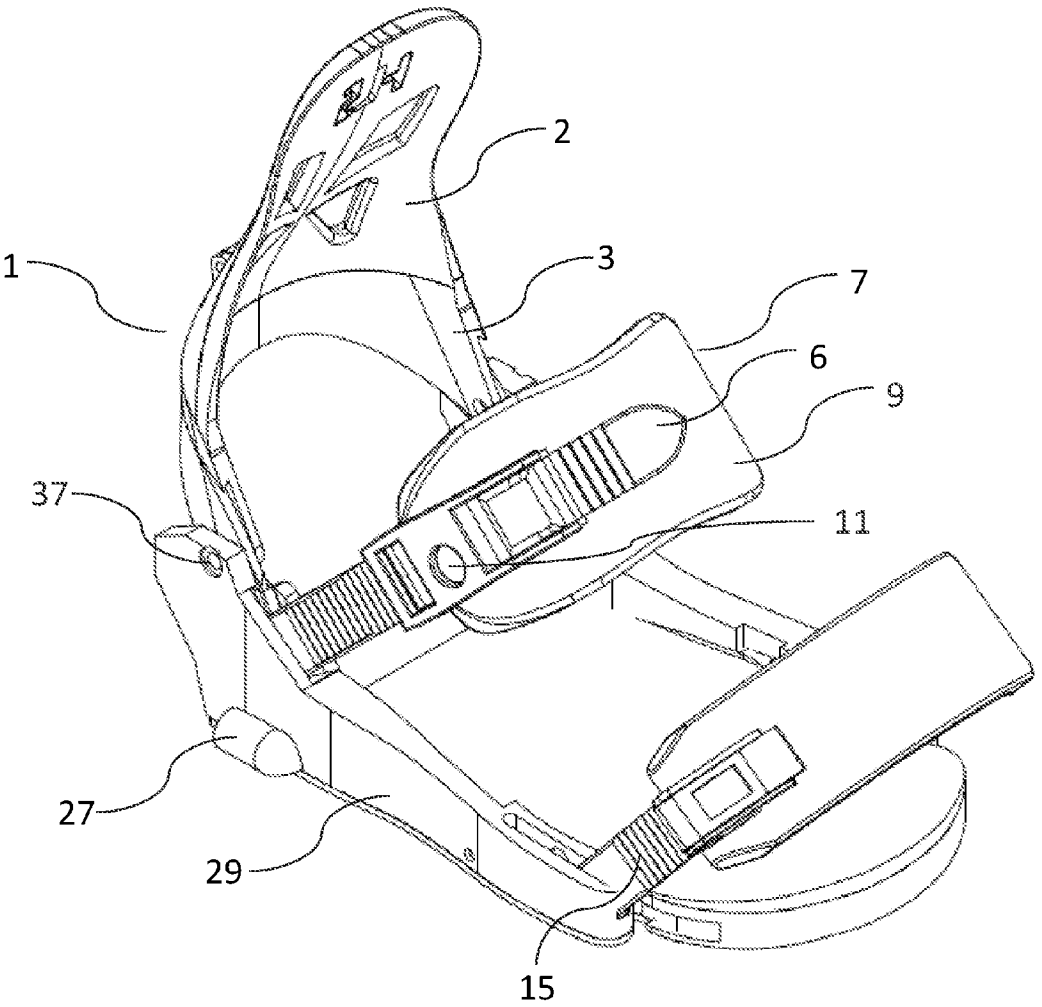
FIGS. 1A-1C depict an embodiment of a heel locking binding system.

Embodiments will now be illustrated with reference to the accompanying figures. Although several embodiments, examples and illustrations are disclosed below, it will be understood by those of ordinary skill in, the art that the inventions described herein extend beyond the specifically disclosed embodiments, examples, and illustrations, and include other uses of the inventions and obvious modifications and equivalents thereof. Embodiments of the inventions are described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments. Furthermore, embodiments may comprise several novel features, no single one of which is solely responsible for its desirable attributes or which is essential to practicing the embodiments herein illustrated.

The disclosure herein provides improved systems for bindings that allow for the insertion, constraint, and removal of an item and that offer enhanced convenience, style, and performance. The binding systems disclosed herein can be used with snowboards and other systems requiring the binding of a human foot to a system, including but not limited to construction equipment, prosthetic limbs or other such equipment, as well as binding footwear such as hiking boots, winter boots, ski boots, skates, snow shoes, water skis, wakeboards, tow-in surfboards, stand up paddle boards, kiteboards, windsurfing boards, other water sports, and hard or soft snowboard boots. Although the present disclosure is described with respect to snowboard bindings, the disclosure is not limited in this regard.

In general, bindings connect one object to another. In the snowboard technology field, bindings connect a rider's boot to the rider's board. The connection between the binding and the snowboard is generally accomplished through semi-permanent, or releasably coupled, connecting apparatuses. For example, the binding and snowboard can be attached with screws or other fasteners that pass through holes or guides in the binding and into holes in the snowboard. The connection between the binding and the boot is generally accomplished by apparatuses that allow the user to secure the boot to the binding and disengage the boot from the binding. This is because, typically, riders connect and disconnect their boots from their bindings frequently during normal use. Boots generally remain attached to the board when the snowboard is being ridden down a hill. However, riders generally disconnect at least one boot after each run, for example, in order to board a chair lift, and reconnect the binding to start their next run.

There are several disadvantages for typical bindings. For example, some bindings must be engaged and disengaged manually during normal use. With conventional strap-style bindings, for example, one or more straps wrap around the boot in order to secure the snowboard boot downwards towards the board and backwards against a highback located along the calf and heel of the user. These conventional strap-style bindings typically have one strap around the toe and another strap around the ankle toward the heel. Conventional strap-style bindings require both straps to be tightened by hand in order to secure the boot within the binding and further require both straps to be removed by hand in order to remove the boot from the binding. To accomplish either task, these and other manually-tightened bindings require riders to sit or bend down, causing them discomfort and wasting valuable time on the slopes.

In an embodiment, a binding system is configured to allow the user to secure a boot within a binding without using his or her hands. For example, the binding can be configured to have an opening into which the user can insert his or her boot. The binding can be configured to secure the boot in the binding after entry by reducing the size of that opening. For example, the user's boot can engage a mechanism that reduces the size of that opening automatically as the user's boot steps on or in the mechanism.

Typical hands-free bindings require additional connecting mechanisms. For example, with conventional "step-in" bindings, movable engagement members on the binding engage with mating engagement members attached to a boot as a user steps into the binding. These conventional step-in bindings lock using the weight of the rider. But these bindings suffer from further disadvantages. These typical step-in bindings require specific boots that house particular components uniquely designed to be coupled with only one type of binding mechanism. This requires a rider's boots to match or be specifically compatible with his or her bindings, which limits the rider's choice of style and color and increases the cost of changing boots.

In an embodiment, binding systems disclosed herein can be configured to be compatible with a standard boot or any kind of boot the user desires. For example, the binding can be configured to secure a boot that does not have special mating engagement members attached. The binding can be configured to secure the boot by enclosing around the boot itself.

Typical hands-free bindings that enclose around the boot itself require large additional mechanisms placed in key locations within the binding. For example, another type of hands-free binding encloses around the boot using a mechanism that extends the entire base plate of the binding. But the presence of such a locking mechanism decreases stability along the entire length of the user's foot. The presence of such a locking mechanism also increases the distance between the boot and the surface of the board along the entire length of the foot, which reduces a rider's feel for the snow, control of the board, and performance down a slope. Further, during use, snow, ice, and debris may accumulate in the mechanism. This can cause the mechanism to malfunction. The presence of the locking mechanism along the entire length of the user's foot allows snow, ice, and debris to accumulate along that entire length. The longer the locking mechanism, the greater the opportunity for snow, ice, and debris to enter and cause malfunction. Therefore, the presence of a locking mechanism that extends the entire base plate of the binding increases the opportunity for malfunction.

In an embodiment, a binding system is configured to enclose around the boot itself using a mechanism that extends less than the entire base plate of the binding and less than the entire length of the user's boot. For example, a mechanism can extend no longer than half the length of the user's boot. In an embodiment, the mechanism can extend to lengths of no more than ½ inch. In embodiments, the mechanism can extend to lengths of no more than 1 inch, 2 inches, 3 inches, 4 inches, 5 inches, 6 inches, 7 inches, 8 inches, 9 inches, 10 inches, 11 inches, 12 inches, or more. For example, a mechanism can be located in a portion of the binding toward the user's heel. In an embodiment, the mechanism can be located at the far end of the heel. In an embodiment, the mechanism can be located other than at the far end of the heel. For example, the mechanism can be located in a middle portion of the binding. For example, the mechanism can be located toward the user's toe. For example, the mechanism can be located at the far end of the toe.

Another drawback of typical hands-free bindings is that they do not reduce their profile size for storage or transport. For example, some typical hands-free bindings contain a highback used to constrain the calf and back heel portion of the boot. When connected, highbacks in typical hands-free bindings extend outwards from the board, either orthogonal or parallel to the surface of the board. In these typical bindings, the highback, does not fold down toward the surface of the board to which it is attached. Reducing the profile size of the board is desirable for travel or storage. But in order to reduce the profile size of the board with typical hands-free bindings containing a highback, the binding must be removed from the board. This generally entails disconnecting the screws or other semi-permanent connection apparatuses between the board and bindings.

In an embodiment, a hands-free binding system with a highback is configured to reduce its profile size without disconnecting the screws or other semi-permanent connection apparatuses between the board and bindings. For example, the highback can be configured to be able to fold down toward the top of the board.

The foregoing shortcomings and disadvantages of typical binding systems can be addressed by the hands-free binding systems disclosed herein. In an embodiment, the system can be configured to allow a boot to be secured in the binding. The system can include a base plate, one or more straps, and a highback. The base plate can be rigidly secured along the top of the snowboard. In an embodiment, the highback can, be connected to the base plate. The highback can be located at the aft portion of the binding, covering the heel, Achilles tendon, and calf of the user, and can extend upward from the top of the snowboard in a direction that is generally orthogonal to the top of the snowboard. In an embodiment, the highback can exist in a state in which it generally resists motion in the aft direction, thereby providing support for the aft portion of the boot. A strap can be configured to wrap around the ankle region of a boot toward the heel. The strap can be comprised of more than one separate elements that may be joined and adjusted for the desired fit. Accordingly, in an embodiment, the boot is constrained in the binding by the base plate, the highback, and a strap. In various embodiments, additional straps can be added and/or combined. For example, an additional strap can be configured to wrap around the toe region of the boot.

In an embodiment, the system can be configured to allow a boot that is secured in the binding to be removed from the binding without removing or adjusting the one or more straps. For example, the highback can be released from a state in which it generally resists motion in the aft direction and can enter into a state in which it is able to rotate with respect to the base plate and the snowboard. For example, the highback can rotate such that the top end of the highback, farthest from the snowboard, moves in the backward (aft) and downward directions. The rotation of the highback can progress sufficiently to allow the boot to be removed from the aft end of the binding.

In an embodiment, the backward and downward rotation of the highback can be accompanied by a forward and upward rotation of one or more straps. In an embodiment, this is accomplished by securing the highback and one or more straps to opposite ends of a rotating member. The backward and downward rotation of the highback can create space between the binding and boot in those directions, while the forward and upward rotation of the one or more straps can create space between the binding and boot in those directions. The combined rotation can increase the size of and reposition an opening formed between the base plate, highback, and strap that constrain the boot. In an embodiment, this rotation can progress sufficiently to allow the boot to be removed from the binding.

In an embodiment, the forward and upward rotation of one or more straps can occur independent from the backward and downward rotation of the highback. In an embodiment, this is accomplished by securing one or more straps to a rotating member that is independent from the highback. The forward and upward rotation of the one or more straps can create space between the binding and boot in those directions. This rotation can increase the size of and reposition an opening formed between the base plate, highback, and strap that constrain the boot, even in the absence of rotation from the highback. In an embodiment, this rotation can progress sufficiently to allow the boot to be removed from the binding.

In an embodiment, the system can further include a heel plate. The heel plate can be located toward the aft of the binding. The heel plate can be interconnected with the base plate, one or more straps, and highback. For example, the heel plate can be connected to the highback by a pin-slot connection. The heel plate can be further configured to rotate with respect to the base plate and/or snowboard along an axis that is parallel to the axis of rotation of the highback. For example, the heel plate can be connected to the snowboard or base plate by pin joints. In an embodiment, a vertical orientation of the highback, normal to top of the snowboard, corresponds to a horizontal orientation of the heel plate, parallel to the top of the snowboard. In an, embodiment, the system can be configured so that rotation of the heel plate in one direction can cause rotation of the highback in the opposite direction. For example, forward and upward rotation of the heel plate can cause backward and downward rotation of the highback, thereby further causing forward and upward rotation of the one or more straps. This rotation of the heel plate can further influence the boot to be expelled from the binding. The rotation of the heel plate with respect to the snowboard and/or base plate can be induced, promoted, or otherwise influenced. For example, torsion springs may be positioned between the base plate and the heel plate to influence the heel plate's forward/upward rotation.

In an embodiment, the system can be configured to allow a boot that has been removed from the binding to be inserted and secured within the binding without removing or adjusting the one or more straps. For example, the boot can be inserted through a sufficiently large opening formed between the base plate, highback, and strap. In an embodiment, this sufficiently large opening occurs when the heel plate has been rotated forward and upwards. As the boot is inserted, the boot can make contact with the heel plate and cause the heel plate to rotate backwards and, downwards. In an embodiment, this backwards and downward rotation of the heel plate causes a corresponding forward and upward rotation of the highback and a corresponding backward and downward rotation of the one or more straps. This can decrease the size of the opening formed between the base plate, highback, and strap, and thereby constrain the boot.

In an embodiment, the system can be configured to be secured around a boot. For example, the system can be configured so that the relative motion among the base plate, highback, and one or more straps is limited, causing the boot to be constrained in the binding. In an embodiment, the system is configured so that limiting the motion of one or more of the interconnected base plate, highback, heel plate, and one or more straps results in limiting the motion of the other interconnected elements. For example, in embodiment, the heel plate is connected to the highback by a pin-slot connection and the highback is connected to the base plate by pin connection. In this embodiment, prohibiting movement of the heel plate with respect to the base plate can thereby prohibit movement of the highback with respect to the base plate and heel plate.

In an embodiment, the system can be configured to remain secured around a boot. For example, a latch can be engaged to prohibit movement of the heel plate with respect to the base plate, thereby prohibiting movement of the highback with respect to the base plate and heel plate. A latch may be formed from parts of the binding system. For example, one or more elements of the binding system may contain or be connected to engagement members such as hooks, lips, bars, press-fits, buttons, pins, ropes, tape, or magnets; and corresponding engagement members may be a part of or connected to one or more other elements. These corresponding engagement members, when engaged, can limit the movement of the elements they are a part of or connected to. For example, the underside of the heel plate may contain hooks, while a corresponding bar can exist on the snowboard or base plate. In an embodiment, when the heel plate is rotated downward toward the snowboard and/or base plate, heel plate hooks can wrap around a corresponding bar on the snowboard or base plate. For example, the material can bend to allow this to occur. For example, the hooks and/or the bar can move relative to one another to allow this to occur. Springs or pins can influence the engaging members to remain in the engaged state.

In an embodiment, the system can be configured to release a boot from a binding. In an embodiment, the system can be configured to be released from the state in which the binding is secured around the boot. For example, engagement members can be disengaged. This can occur directly or indirectly. For example, in the case of a hook and bar, a user can manipulate the bar so that the bar clears the hooks. For example, in the case of a hook and bar, the user can manipulate a member connected to the bar, rigidly or through joints, so that the bar clears the hooks. In an embodiment, the system is configured to disengage the latch upon a threshold level of force or pressure experienced in the system. In an embodiment, a locking pin is included to keep the latch engaged until removed or broken.

In an embodiment, the heel plate is a solid plate that extends along the entire base plate. But the presence of a solid heel plate and latching mechanism along the entire base plate can reduce a rider's feel for the snow, control of the board, and performance down a slope, and can allow the accumulation of snow, ice, and debris to occur along that entire length.

Accordingly, it can be advantageous for the base plate to extend less than the entire base plate. For example, the base plate can extend no longer than half the length of the base plate. For example, the base plate can extend no longer than one-quarter of the length of the base plate.

To further reduce accumulation of snow, ice, and debris beneath the heel plate, it can also be advantageous to cut out material from the heel plate. For example, instead of comprising a solid plate, the heel plate can comprise an outline. In an embodiment, the heel plate can be O-shaped, oval shaped, or shaped in a rectangular outline. The heel, plate can comprise an arc. The heel plate can have an arc length of less than one inch. In embodiments, the heel plate can have arc lengths of less than 2 inches, 4 inches, 6 inches, 8 inches, 10 inches, and 12 inches. The heel plate can have an arc length of 12 inches or greater. The heel plate can have variable arc lengths. The difference between a heel plate arc's outer and inner radii can be less than 1 inch, 2 inches, 3 inches, 4 inches, 5 inches, 6 inches, or 6 inches or more. The difference between a heel plate arc's outer and inner radii can be variable. The heel plate can be U-shaped or horseshoe shaped. In an embodiment, the heel plate can be in the shape of a line. For example, the heel plate can be a narrow member. The heel plate can be T-shaped. The width of the heel, plate can vary such that it comprises combinations of shapes. For example, the heel plate can comprise a T-shape that additionally includes material on the lines of the T, which appear like buttons. In an embodiment, heel plate is configured to push away snow and debris as it rotates toward the base plate and/or snowboard. The width and/or thickness of the heel plate can be variable. For example, the bottom of the heel plate can be narrower than the top of the heel plate, including coming to a point. The bottom of the heel plate can be thicker than the top of the heel plate.

The heel plate can comprise a generally rigid material or composite. For example, the heel plate can comprise metal, hard plastic, or wood. The heel plate can be configured to be greater than one inch thick. Alternatively, the heel plate can be less than one inch thick. For example, the heel plate can have thicknesses of one-half, one-quarter, or one-eighth inches, or less. The thickness of the heel plate can be variable. The heel plate can be configured to be as wide as the inside of the binding, measured from the medial to lateral sides. Alternatively, the heel plate can be less than the width of the inside of the binding. For example, it could be half, one-quarter, or one-eighth that width, or less.

In an embodiment, the heel plate contacts the base plate at the point the latch is able to engage, thereby securing the item. Alternatively, the binding system may be configured so that the latch is able to engage prior to the point at which the heel plate would contact the base plate, which would allow the binding to enter the locked system state even if snow, ice, or debris were to accumulate between the base plate and heel plate. The binding system may also be configured to have sequentially placed latches, which would engage successively as the heel plate rotates toward the base plate. This configuration would further allow for the accumulation of snow, ice, or debris between the base plate and heel plate. With such, accumulation, the heel plate may not be pressed as closely to the base plate as without. Further with such accumulation, only some of the latches may engage. However, as the snow, ice, or debris is dissipated, compacted, or removed, downward forces exerted, for example, by a snowboarder would cause further latches to engage and tighten the binding.

In an embodiment, portions of the heel plate and/or base plate can comprise padding or other compressible material to improve the latch, provide comfort, and allow the binding to enter the locked system state even if snow, ice, or debris were to accumulate between the base plate and heel plate. In an embodiment, the binding system may be configured so that the latch is only able to engage after the point at which the heel plate would contact the base plate, requiring the compressible material of the heel plate and/or base plate to compress before latching occurs.

The surface texture of the heel plate can be configured to promote or reduce slipping between the heel plate and the boot or other item to be constrained. For example, the heel plate surface texture can be rough to reduce slipping or smooth to promote slipping. The top of the heel plate can be configured to help guide the boot into the binding. For example, the top of the heel plate may contain a lip or other visible and/or tangible marker.

The system can be configured so that a sufficiently large opening to insert a boot corresponds to a certain angle of the heel plate with respect to the base plate and/or snowboard. For example, a sufficiently large opening to insert a boot can correspond to heel plate angles of between 90 degrees and less than one degree, such as 90 degrees, 45 degrees, 30 degrees, and 5 degrees. The system can also be configured so that a sufficiently large opening to insert a boot corresponds to certain horizontal and/or vertical positions of the heel plate. The rotation of the heel plate can be limited or unlimited. For example, the heel plate can be forced to stop at a certain angle with respect to the base plate or snowboard, or at a certain horizontal and/or vertical position.

In an embodiment, the heel plate is positioned toward the aft of the binding. In an embodiment, the heel plate is positioned toward the center of the binding. In an embodiment, the heel plate is positioned toward the forward portion of the binding.

In an embodiment, the binding system can be configured to be able to have a changeable profile. For example, the highback may comprise two or more connected elements. In an embodiment, the system can be configured to permit movement among those elements. For example, the highback may comprise two elements. A first element can comprise the portion of the highback that is farther from the base plate, and a second element can comprise the portion of the highback that is closer to the base plate, when the highback is positioned so that it is generally orthogonal to the top of the snowboard. These elements can be connected to allow rotation among them. For example, they can be connected by pin joints. In an embodiment, the first element can rotate with respect to the second element toward the base plate and snowboard. In an embodiment, the system can be further configured to prohibit movement among the highback elements, thereby forming a rigid body to be used for binding. In an embodiment, the system can be configured to prohibit movement among the highback elements by engaging a fastener between each member. For example, a fastener may be a bolt, screw, adhesive, pin, rope, staple, stitching, material, wrapping, button, grip, tape, magnet, or vacuum. The system can be configured to permit movement among the highback elements by disengaging the fastener(s).

Figure 1B:
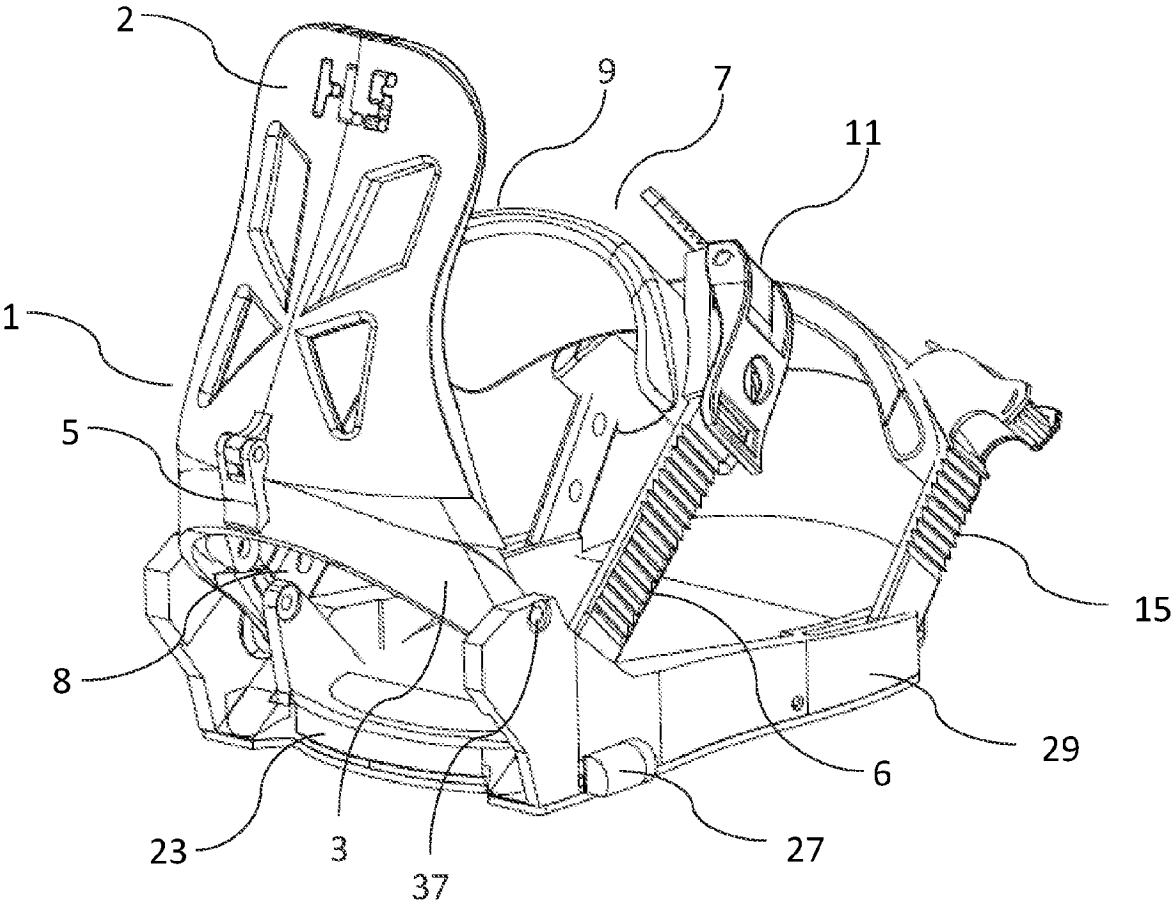
Figure 1C:
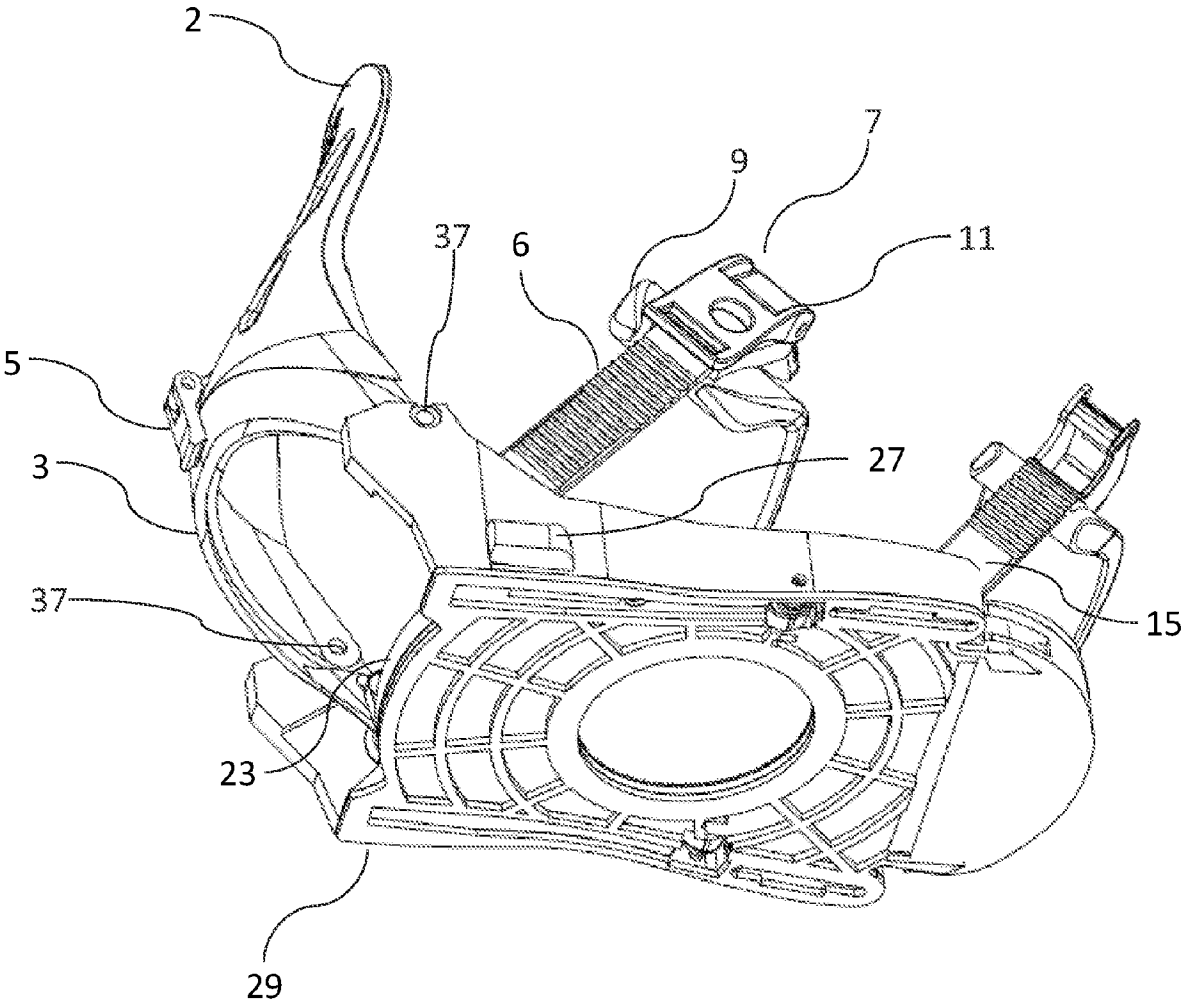

FIGS. 1A-1C depict an embodiment of a heel locking binding system. In an embodiment, the binding comprises a base plate 29, a highback 1, a fastener 5, a toe strap 15, a heel plate 23, a release lever 27, pin joints 37, and a heel strap 7. FIGS. 1A-1C illustrate an example of an embodiment of a heel locking binding system having those components. The embodiments referenced herein are with respect to connecting the right foot of a user to a snowboard. Herein, the term "lateral side" is used to refer to the side of the binding facing outward and away from the other binding during operation, that is, the right side of the right binding. Herein, the term "medial side" is used to refer to the side of the binding facing inward and toward the other binding during operation, that is, the left side of the right binding. Highback 1 can comprise medial and lateral sides and comprise a first portion 2 and a second portion 3. The heel strap 7 helps constrain an item in the binding system. The heel strap 7 may further comprise a lateral portion 6, a medial portion 8, a pad 9, and a ratchet 11. In this example, the highback 1 is connected to the base plate 29 by pin joints 37. In this example, a boot 33 or other item can be placed, on top of the base plate 29. When a boot 33 is used, the heel of the boot 33 may be located toward the aft portion, containing the heel plate 23, and the toe of the boot located toward the forward portion, containing toe strap 15.

In the example of the embodiment depicted in FIGS. 1A-1C, the base plate 29 can be connected to the highback 1 using pin joints 37. This can allow the base plate 29 and highback 1 to move rotationally relative to one another. The heel strap 7 can be connected, either directly or indirectly, to the medial and lateral sides of the highback 1 to help constrain the item in the binding during use. For example, FIGS. 1A-1C show heel strap lateral portion 6 connected to the lateral side of highback 1 and further connected to the heel strap pad 9 by the heel strap ratchet 11. Heel strap pad 9 is further connected to heel strap medial portion 8, which is then connected to the medial side of the highback 1. The length of the heel strap 7 can also be adjusted. This adjustment can be provided by, for example, the heel strap ratchet 11. The heel strap lateral portion 6 may be removed from the heel strap ratchet 11 when the binding system is initially set up. To continue initial set up, an item may be placed in the binding, the heel strap lateral portion 6 may be inserted into the heel strap ratchet 11, and the heel strap 7 may be adjusted for the desired fit. After this initial set up, the mechanism illustrated below can provide tightening and loosening sufficient to insert and remove the item without disconnecting or adjusting the heel strap 7.

Figure 2:
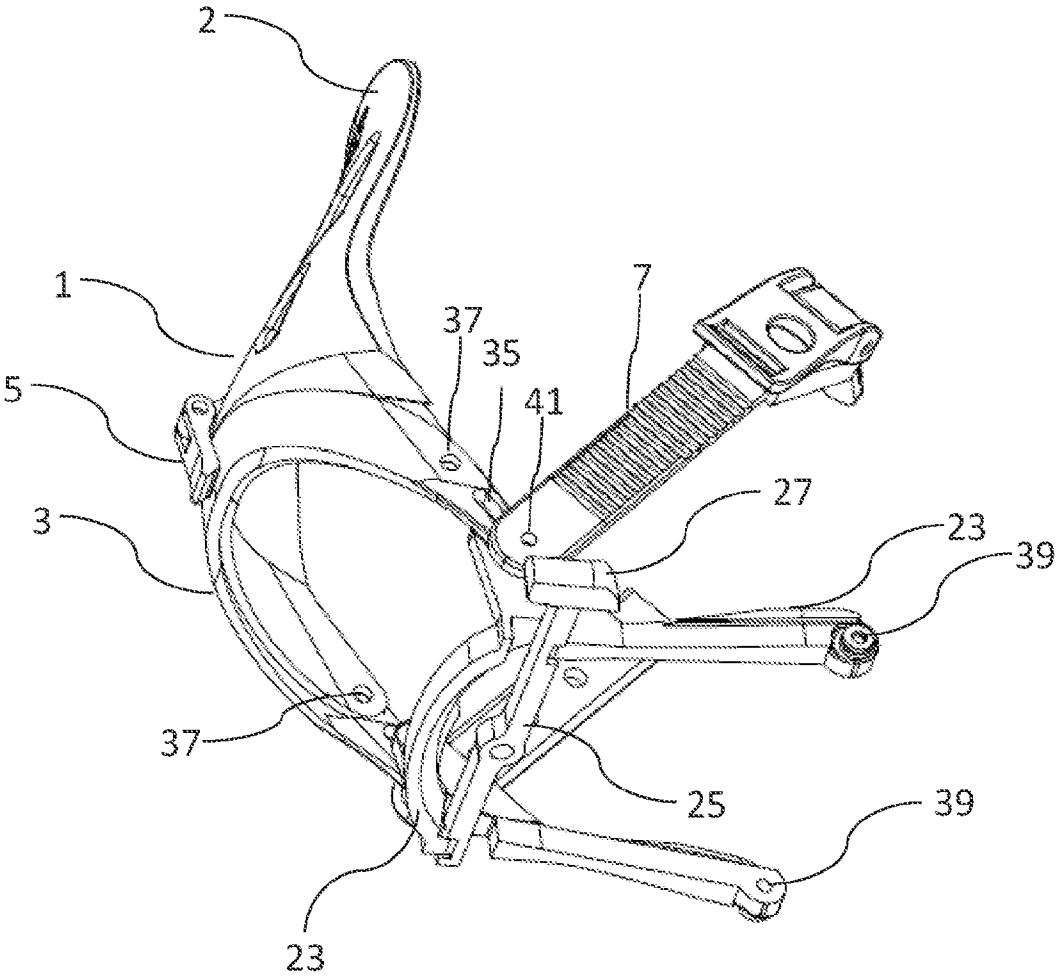
FIG. 2 depicts an embodiment of a heel locking binding system in which portions of the system have been hidden.

FIG. 2 depicts an embodiment of a heel locking binding system in which portions of the system have been hidden. In an embodiment, the binding further comprises a locking bar 25 and pin-slot connections 35. FIG. 2 illustrates an example of an embodiment of a heel locking binding system having those components. In this example, the base plate 29 (not shown) can be connected to the heel, plate 23 by pin joints 39. The heel plate 23 and locking bar 25 can be configured to form a latch. The heel plate 23 can also be connected to the medial and lateral sides of highback 1 by pin-slot connections 35. The medial and lateral sides of highback 1 can be connected to the heel strap 7 by pin joints 41. Locking bar 25 can be rigidly connected to release lever 27.

Figure 3A:
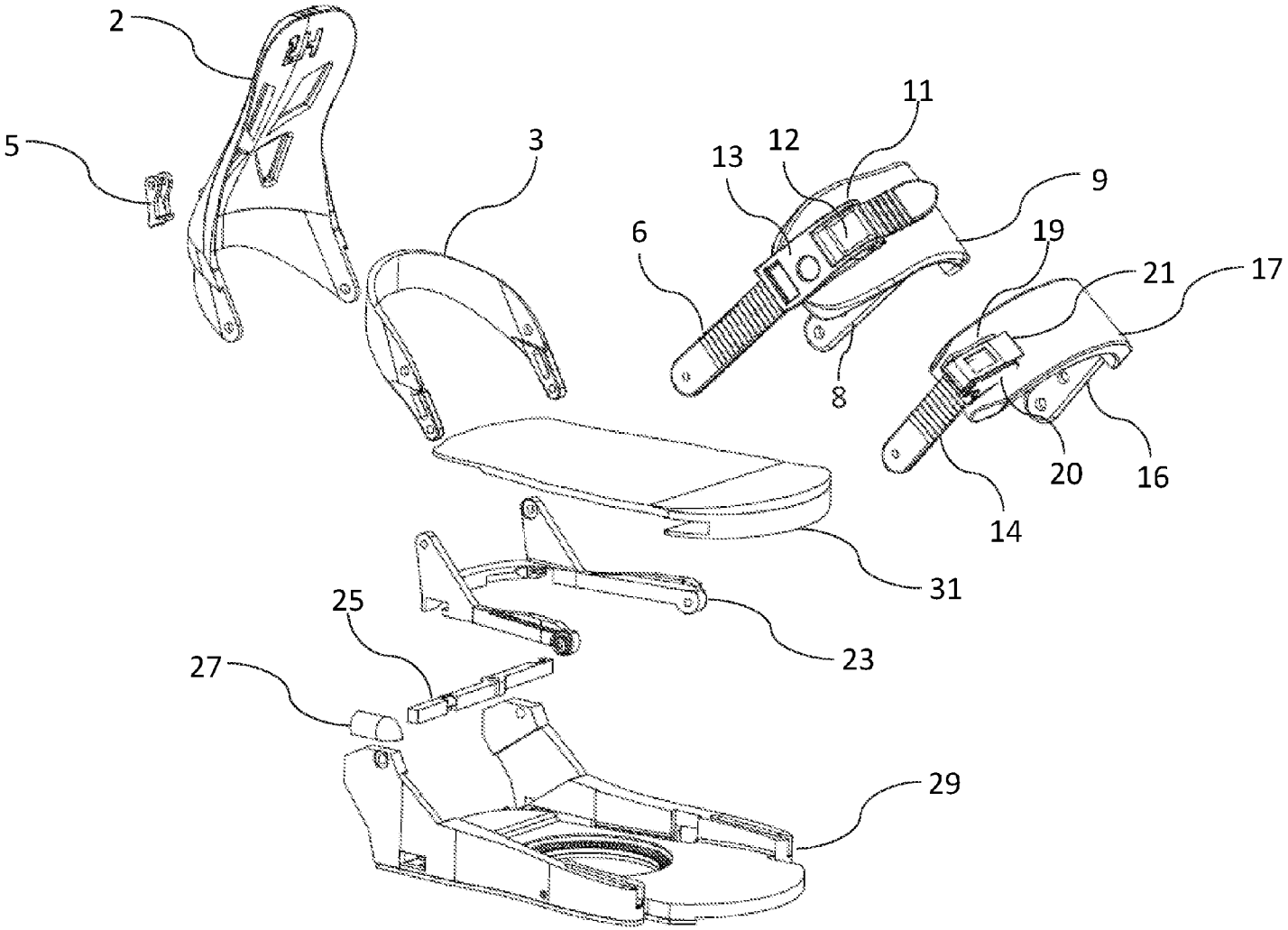
FIGS. 3A-3B depict exploded views of an embodiment of a heel locking binding system.
Figure 3B:
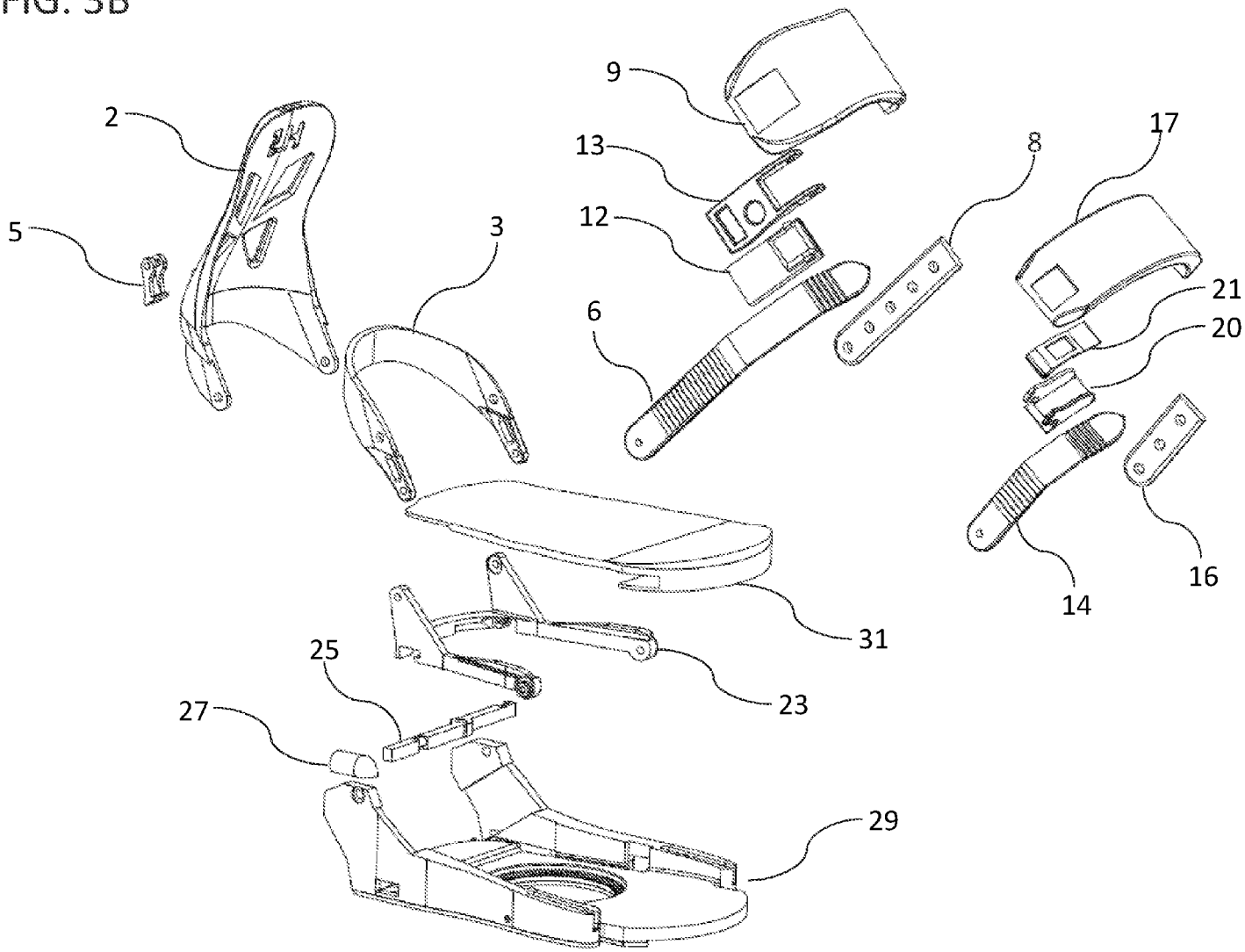

FIGS. 3A-3B depict exploded views of an embodiment of a heel locking binding system. In an embodiment, the binding further comprises a toe strap pad 17 and, a base plate pad 31. The binding of this embodiment further includes a toe strap ratchet 19 comprising a toe strap ratchet base 20 and a toe strap ratchet buckle 21. The heel strap ratchet 11 in this embodiment comprises a heel strap ratchet base 12 and a heel strap ratchet buckle 13. FIGS. 3A-3B illustrate an example of an embodiment of a heel locking binding system having those components. In this example, the heel strap 7 can comprise several pieces, including heel strap lateral portion 6, heel strap medial portion 8, heel strap pad 9, and heel strap ratchet 11. Heel strap lateral portion 6 can be connected directly or indirectly to heel strap medial portion 8. In this example, this connection is accomplished through heel strap pad 9 and heel strap ratchet 11. The toe strap 15 can comprise several, pieces, including toe strap lateral portion 14 and toe strap medial portion 16, toe strap pad 17, and toe strap ratchet 19. Toe strap lateral portion 14 can be connected directly or indirectly to toe strap medial portion 16. In this example, this connection is accomplished through toe strap pad 17 and toe strap ratchet 19. The base plate pad 31 may be placed over the base plate 29 for cushioning and improved fit between the item and binding.

Figure 4A:
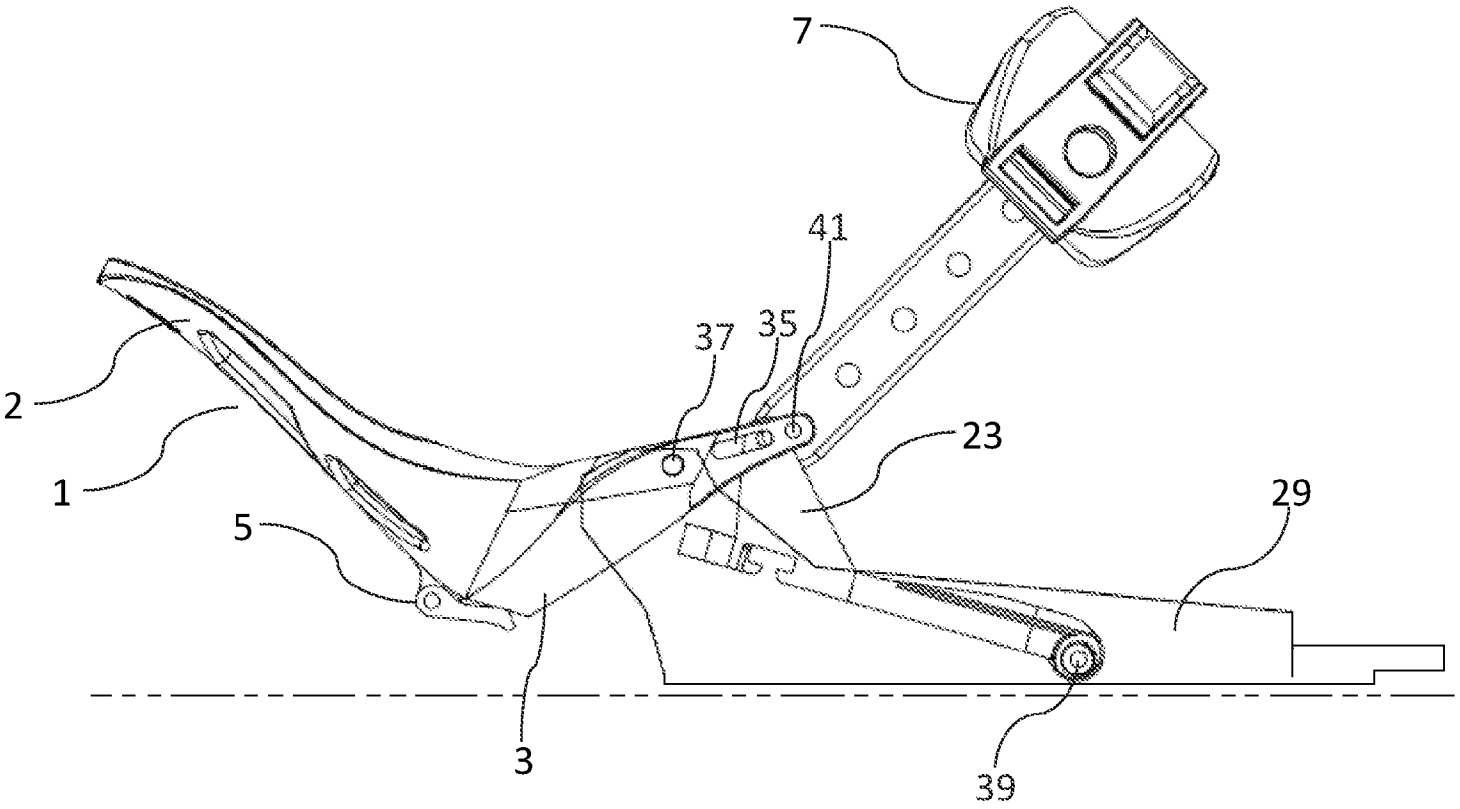
FIGS. 4A-4C depict side views of an embodiment of a heel locking binding system in which portions of the system have been hidden or are shown in outline.
Figure 4B:
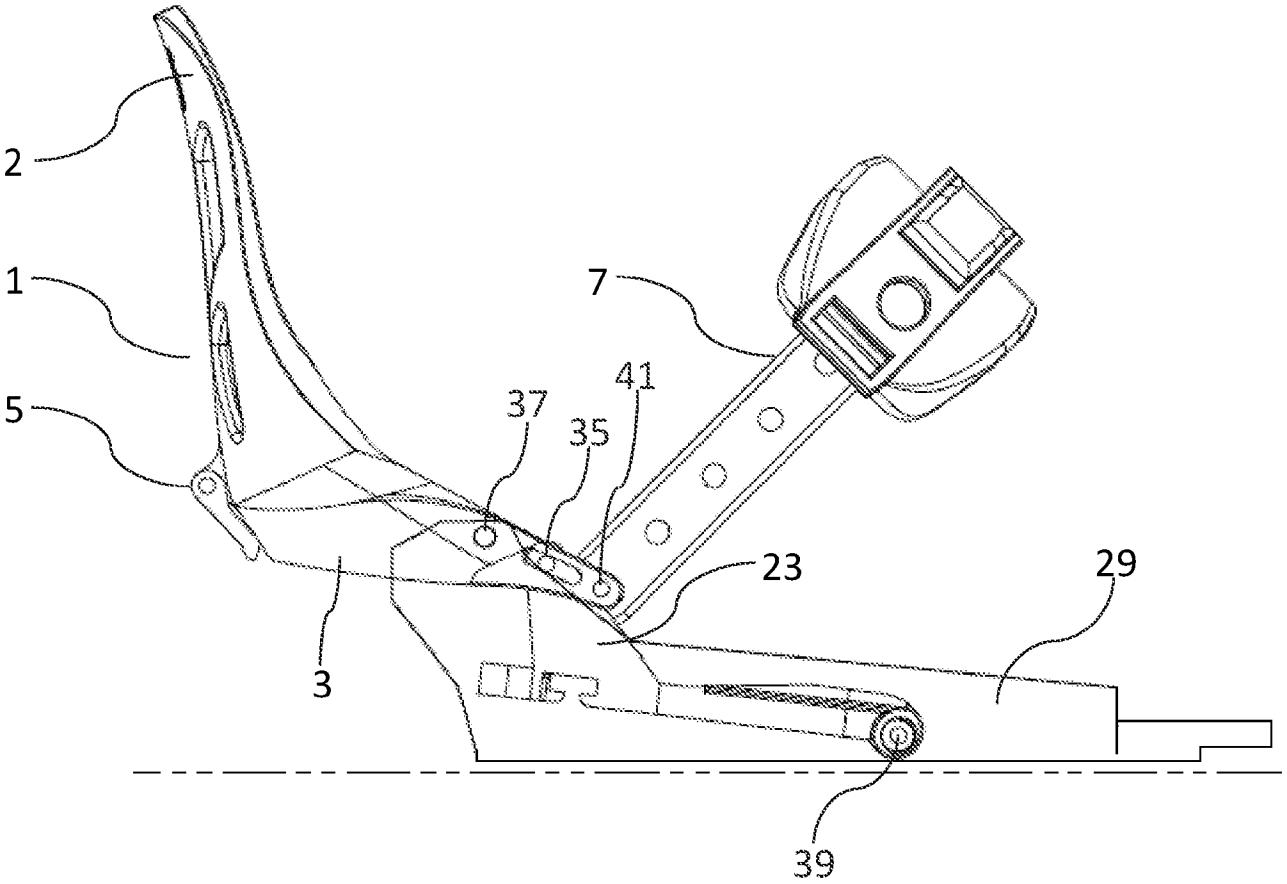
Figure 4C:
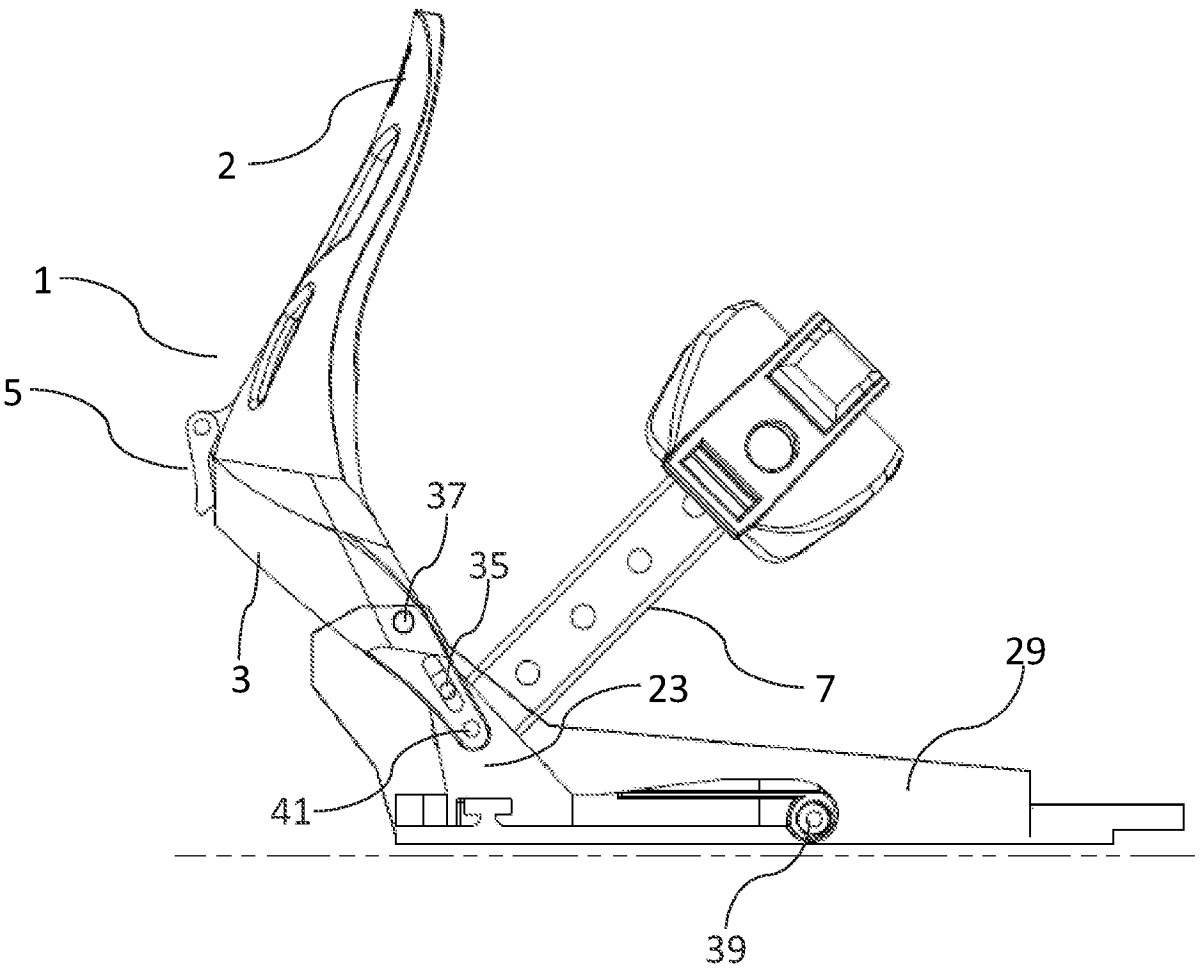

FIGS. 4A-4C depict side views of an embodiment of a heel locking binding system in which portions of the system have been hidden or are shown, in outline. In an embodiment, an opening may be formed between the base plate 29, the highback 1, and the heel strap 7. In an embodiment, the base plate 29 and highback 1 are able to move relative to one another to change the size of that opening. In another embodiment, the base plate 29 and heel strap 7 are able to move relative to one another to change the size of that opening. In another embodiment, the base plate 29, highback 1, and heel strap 7 are able to move relative to one another to change the size of that opening.

In an embodiment, the binding system further comprises a heel plate 23. In that embodiment, the base plate 29, heel plate 23, and one or both of the highback 1 and heel strap 7 are able to move relative to one another to change the size of an opening formed between the base plate 29, the highback 1, and the heel strap 7. In one example of such an embodiment, the heel strap 7 is connected to the highback 1 by pin joints 41, the highback 1 is connected to the base plate 29 by pin joints 37, the base plate 29 is connected to the heel plate 23 by pin joints 39, and the heel plate 23 is connected to the highback 1 by pin-slot connections 35. FIGS. 4A-4C illustrate an example of such an embodiment of a heel locking binding system. FIGS. 4A-4C show only the outline of the base plate 29.

Figure 5A:
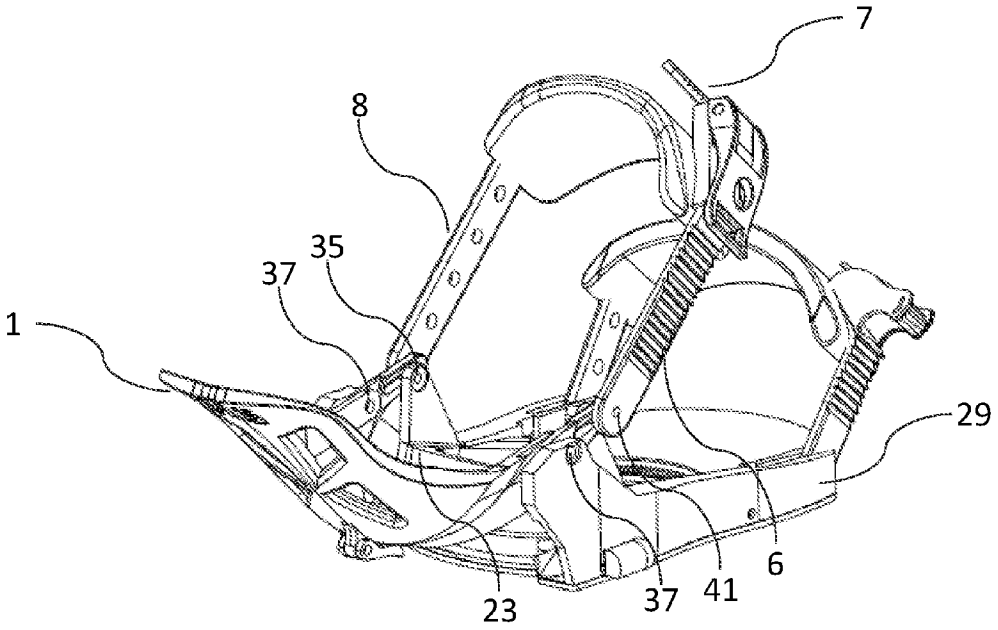
FIGS. 5A-5C depict an embodiment of a heel locking binding system.
Figure 5B:
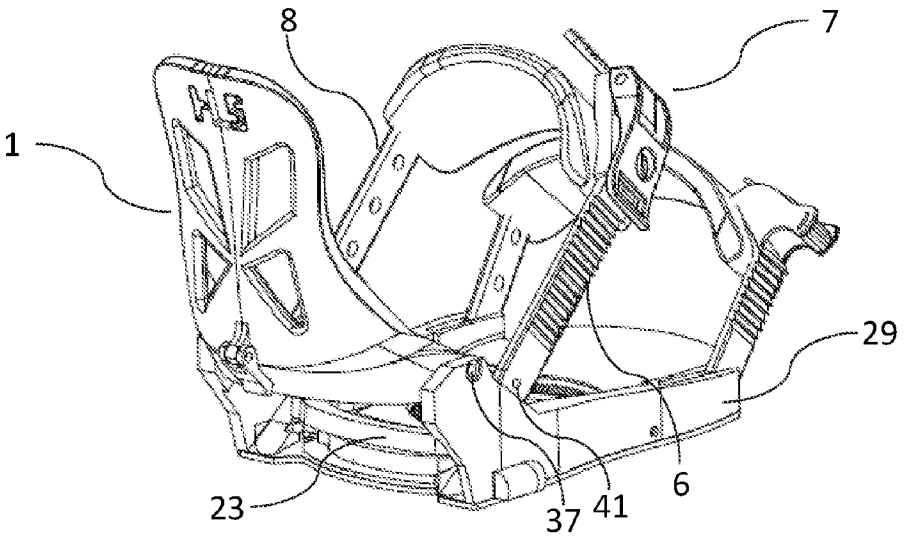
Figure 5C:
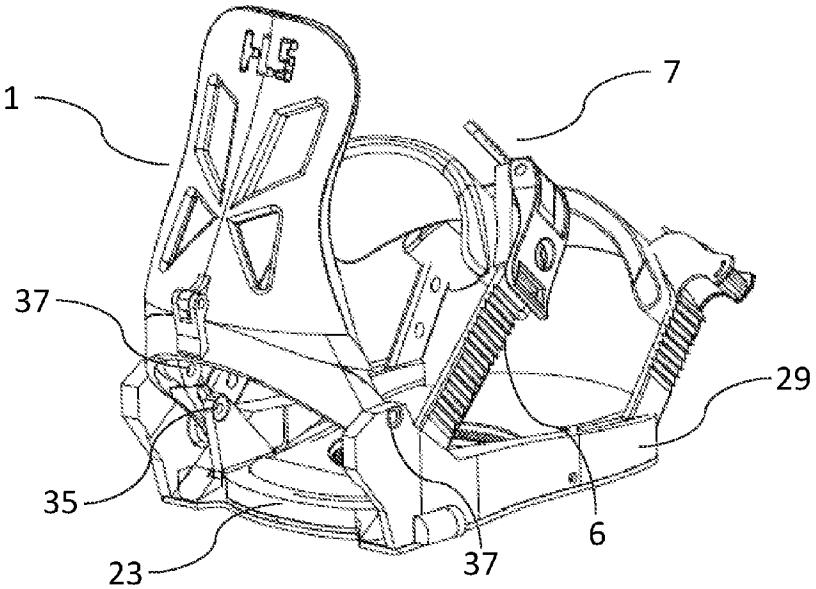
Figure 6A:
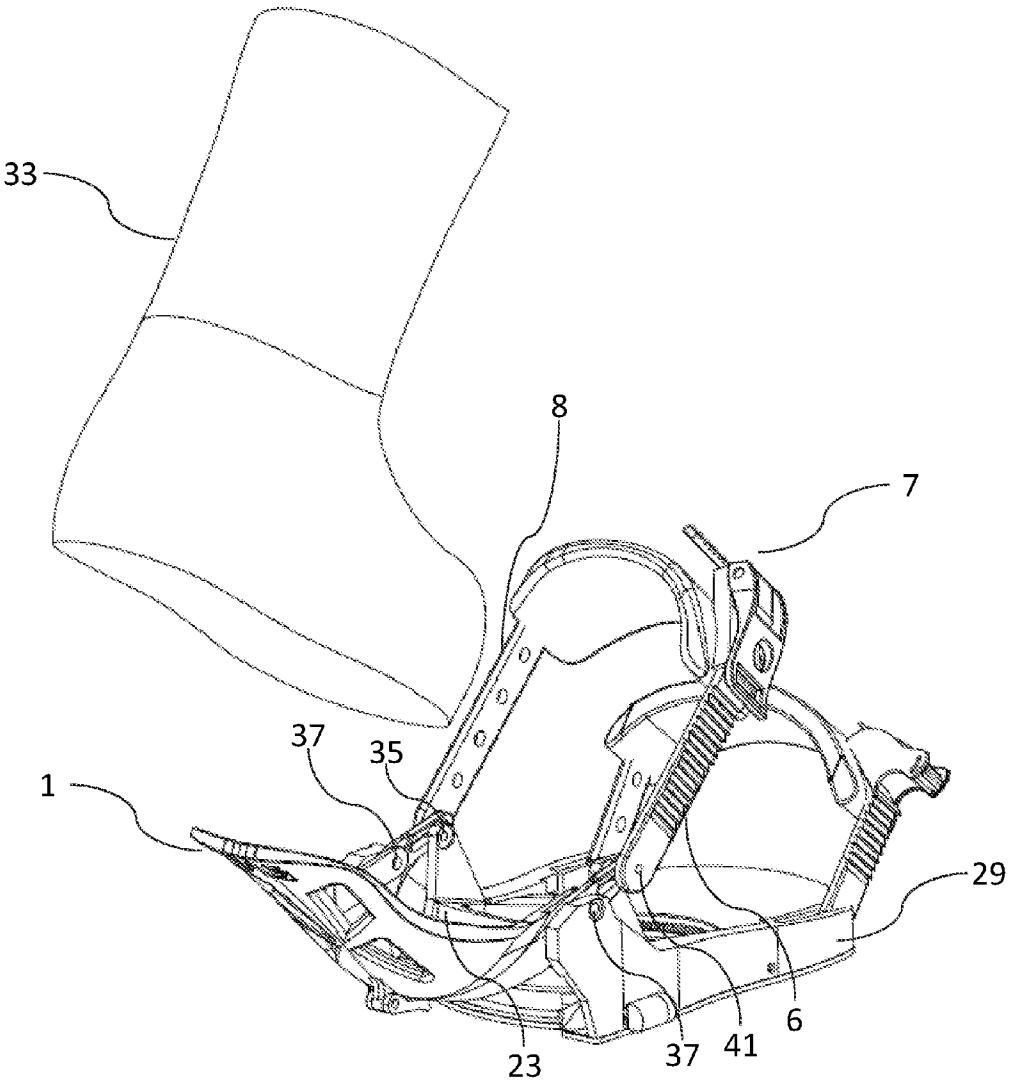
FIGS. 6A-6D depict the insertion of a boot into an embodiment of a heel locking binding system.
Figure 6B:
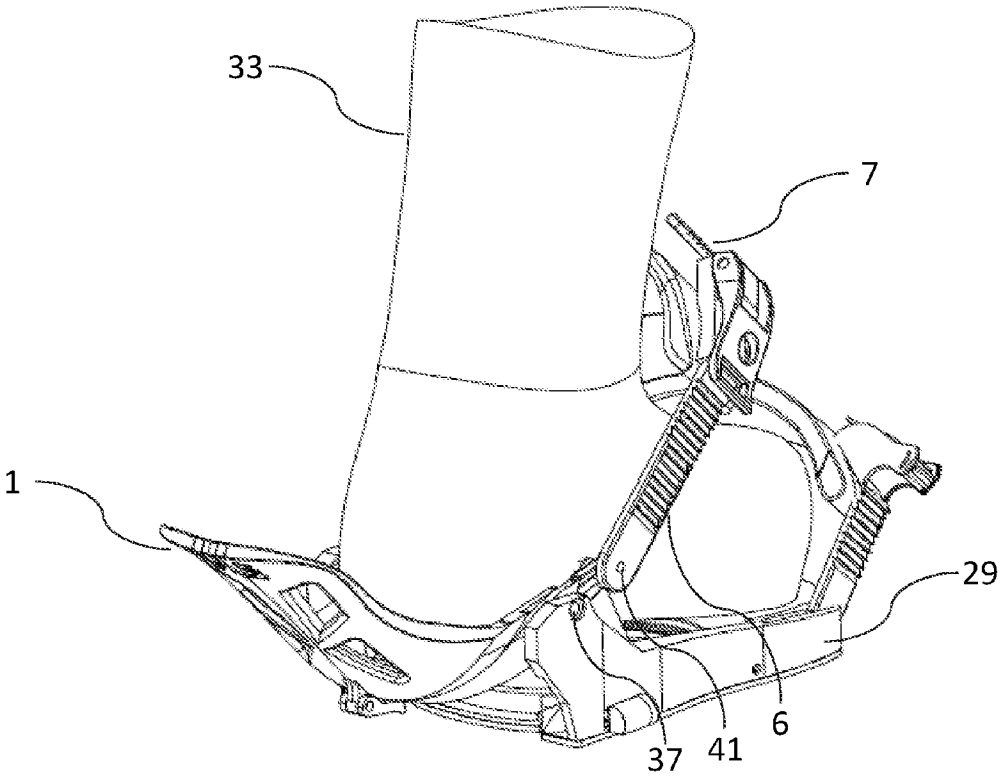
Figure 6C:
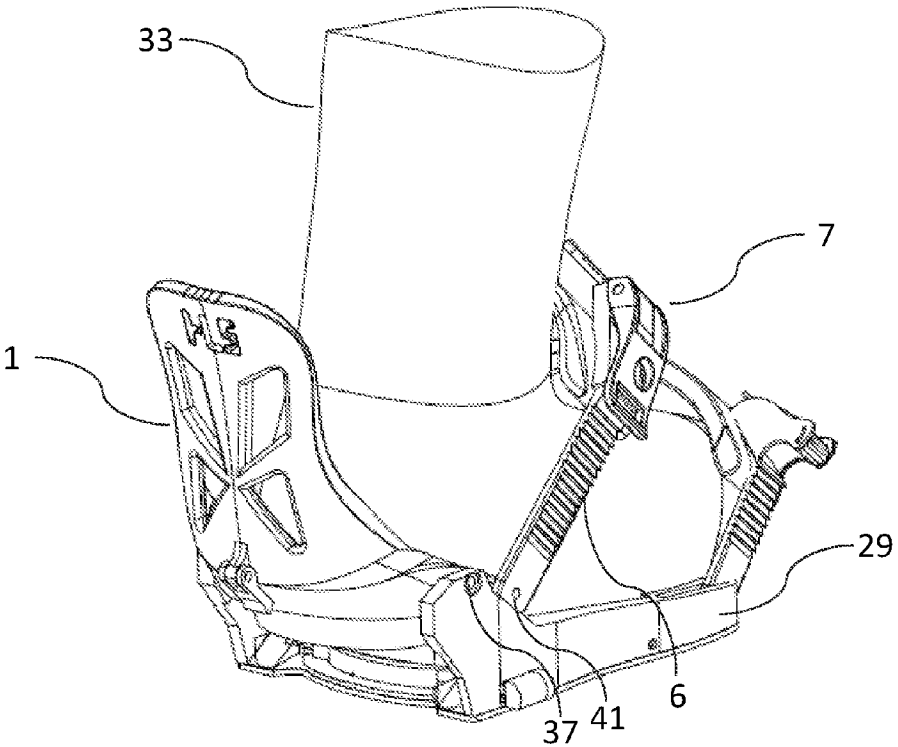
Figure 6D:
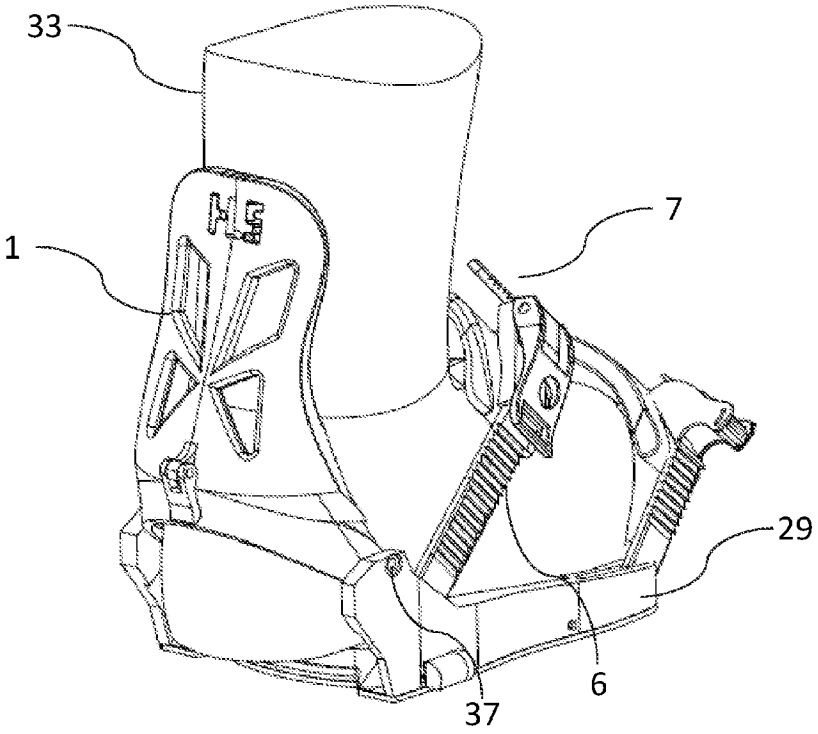
Figure 7A:
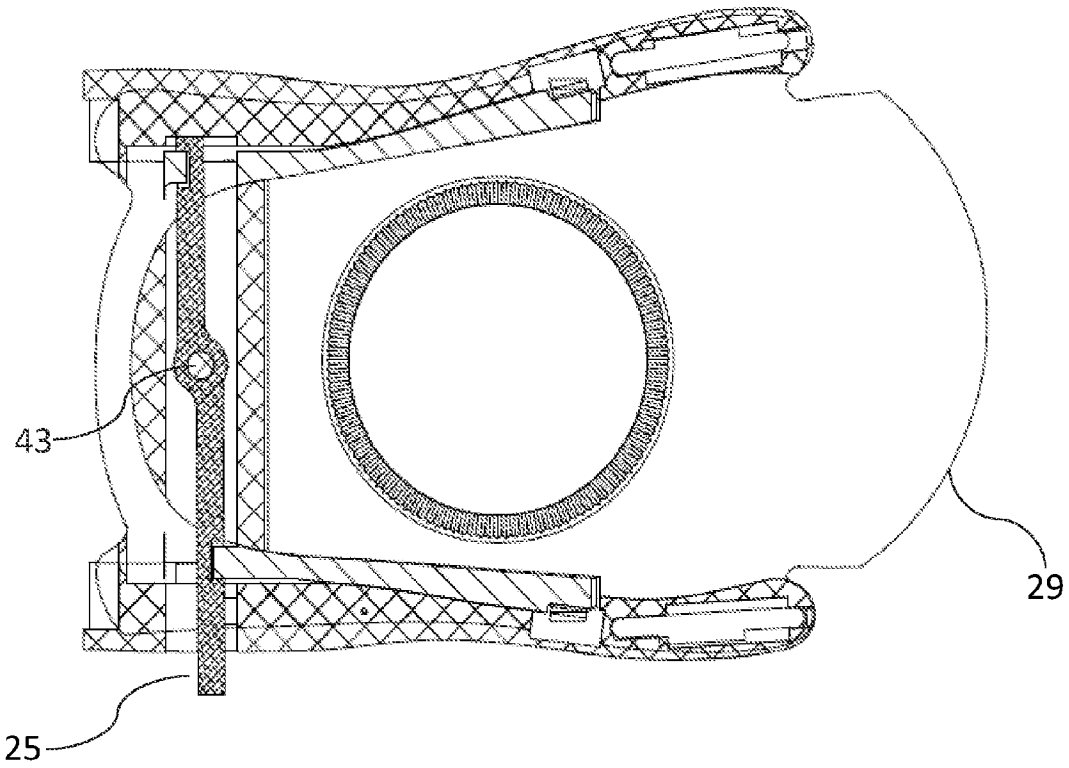
FIGS. 7A-7E depict top sectional views of an embodiment of a heel locking binding system in which portions of the system have been hidden.
Figures 7B, 7C, 7D, 7E:
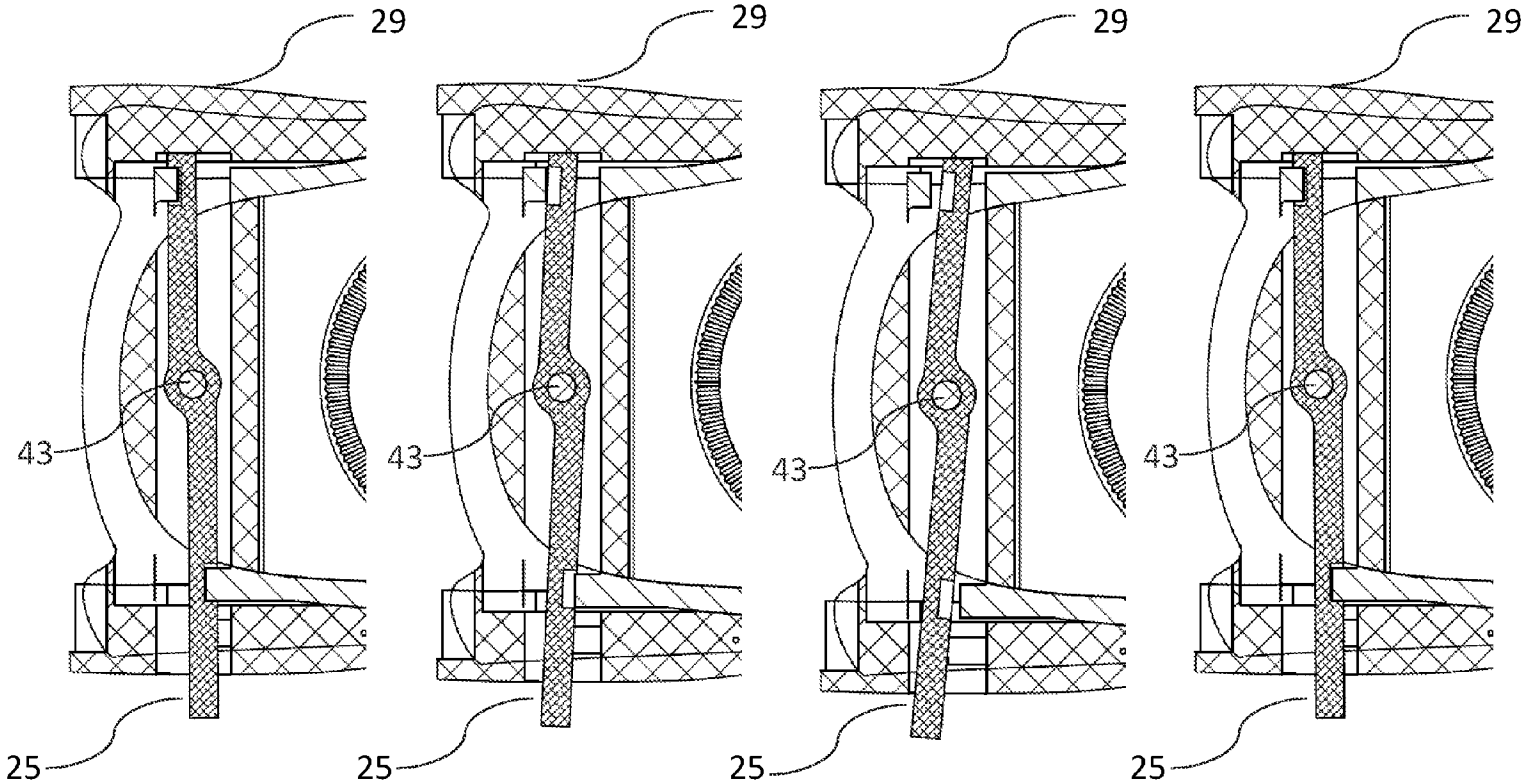

FIGS. 5A-5C depict an embodiment of a heel, locking binding system. The opening formed between the base plate 29, the highback 1, and the heel strap 7 is further shown in FIGS. 5A-5C. In this embodiment, the base plate 29, highback 1, and heel strap 7 are able to move relative to one another to tighten or loosen around an item by decreasing or increasing the size of the opening, respectively. In the embodiment depicted in FIGS. 5A-5C, rotation of highback 1 relative to base plate 29 around pin joints 37 causes heel strap 7 to move towards or away from the location of an item to be secured in the binding system. The movement of the highback 1 and heel strap 7 relative to base plate 29 decreases or increases the opening between the base plate 29, highback 1, and heel strap 7, thereby allowing the binding to tighten or loosen around the item. This motion can be caused, aided, impeded, or otherwise affected by one of several apparatuses known in the art. For example, the user can affect this motion. The binding system may further comprise a heel plate 23, as described above with reference to FIGS. 4A-4C. Torsion springs may be positioned between the base plate 29 and the heel plate 23 to influence rotation around the pin joints 39 connecting them.

FIGS. 6A-6D depict the insertion of a boot 33 into an embodiment of a heel locking binding system. In an embodiment, the opening formed between the base plate 29, the highback 1, and the heel strap 7 is sufficiently large to allow the boot 33 to enter. This can correspond with a heel plate 23 that has been rotated forward and upwards. As the boot 33 is inserted into an embodiment, the boot 33 can make contact with the heel plate 23 and cause the heel plate to rotate backwards and downwards. In an embodiment, this backwards and downward rotation of the heel plate 23 causes a corresponding forward and upward rotation of the highback 1 and, backward and downward rotation of the heel, strap 7. This can decrease the size of the opening formed between the base plate 29, the highback 1, and the heel strap 7, causing the binding system to tighten around boot 33 and thus constraining the boot 33 in the binding system.

FIGS. 7A-7E depict top sectional views of an embodiment of a heel locking binding system in which portions of the system have been hidden. In an embodiment, the base plate 29 is connected to the locking bar 25 by pin joint 43, enabling the locking bar 25 to rotate with respect to the base plate 29 around pin joint 43. FIGS. 7A-7E illustrate an example of an embodiment of a heel locking binding system having this capability. In, this embodiment, the locking bar 25 may be further connected to release lever 27. The rotation of locking bar 25 with respect to base plate 29 around pin joint 43 can be caused, aided, impeded, or otherwise affected by one of several apparatuses known in the art, such as compression springs embedded in base plate 29.

In an embodiment, the binding system may comprise one or more locked system states in which certain portions of the system are unable to move relative to one another. In, the locked system state of one embodiment, the highback 1 and base plate 29 are unable to move relative to one another. Embodiments may alternatively comprise one or more unlocked system states in which portions of the system are able to move relative to one another. In the unlocked system state corresponding to the locked system state in the previous example, the highback 1 and base plate 29 are able to move relative to one another.

In an embodiment, whether or not locked or unlocked system states exist, the binding system may comprise one or more semi-locked system states in which certain portions of the system, are unable to move relative to one another other than certain prescribed motions. In the semi-locked system state of one embodiment, the heel strap 7 and base plate 29 are unable to move relative to one another other than one degree of rotation around pin joints 41. Embodiments having one or more semi-locked system states may alternatively comprise one or more unlocked system states in which portions of the system are able to move relative to one another in addition to the certain prescribed motions in the semi-locked state. In the unlocked system state corresponding to the semi-locked system state in the previous example, the heel strap 7 and base plate 29 are able to move relative to one another in addition to one degree of rotation around pin joints 41, including second degree motion via the motion of highback 1 around pin joints 37 and third degree motion further via the motion of base plate 23 around pin joints 39 and with respect to pin-slot connections 35.

FIGS. 8A-8E depict side sectional views of an embodiment of a heel locking binding system in which portions of the system have been hidden. An embodiment may be configured to enable the binding system to enter into, remain in, and be released from locked and/or semi-locked system states. FIGS. 8A-8E illustrate an example of such an embodiment. In this embodiment, the highback 1 is connected to the base plate 29 by pin joints 37, the base plate 29 is connected to the heel plate 23 by pin joints 39, and the heel plate 23 is connected to the highback 1 by pin-slot connections 35. In this embodiment, the base plate 29 is further connected to the locking bar 25 by pin joint 43, as described with reference to FIGS. 7A-7E, and the locking bar 25 and heel plate 23 are configured to form a latch. A latch allows for conditions under which locking bar 25 and heel plate 23 are unable to move relative to each other. One example of such a latch will be further described with reference to the embodiment depicted in FIGS. 8A-8E.

Figure 8A:
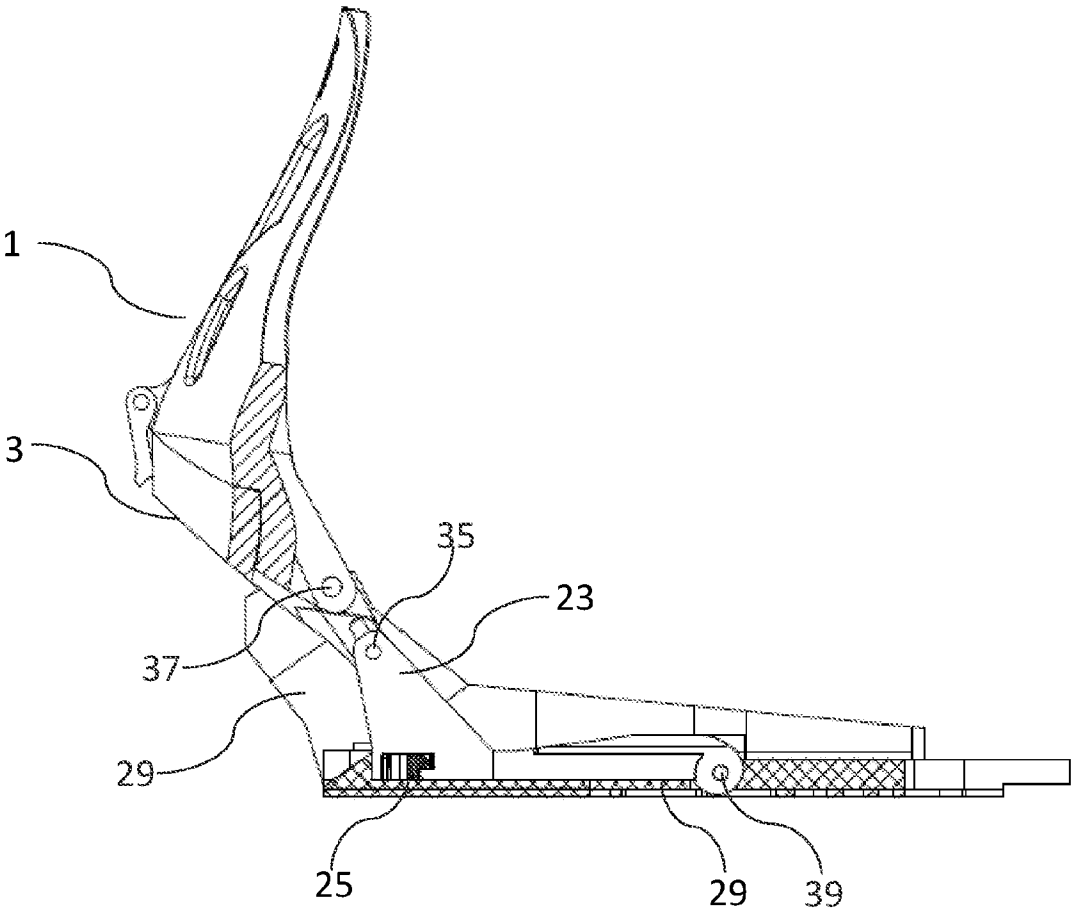
FIGS. 8A-8E depict side sectional views of an embodiment of a heel locking binding system in which portions of the system have been hidden.
Figure 8B:
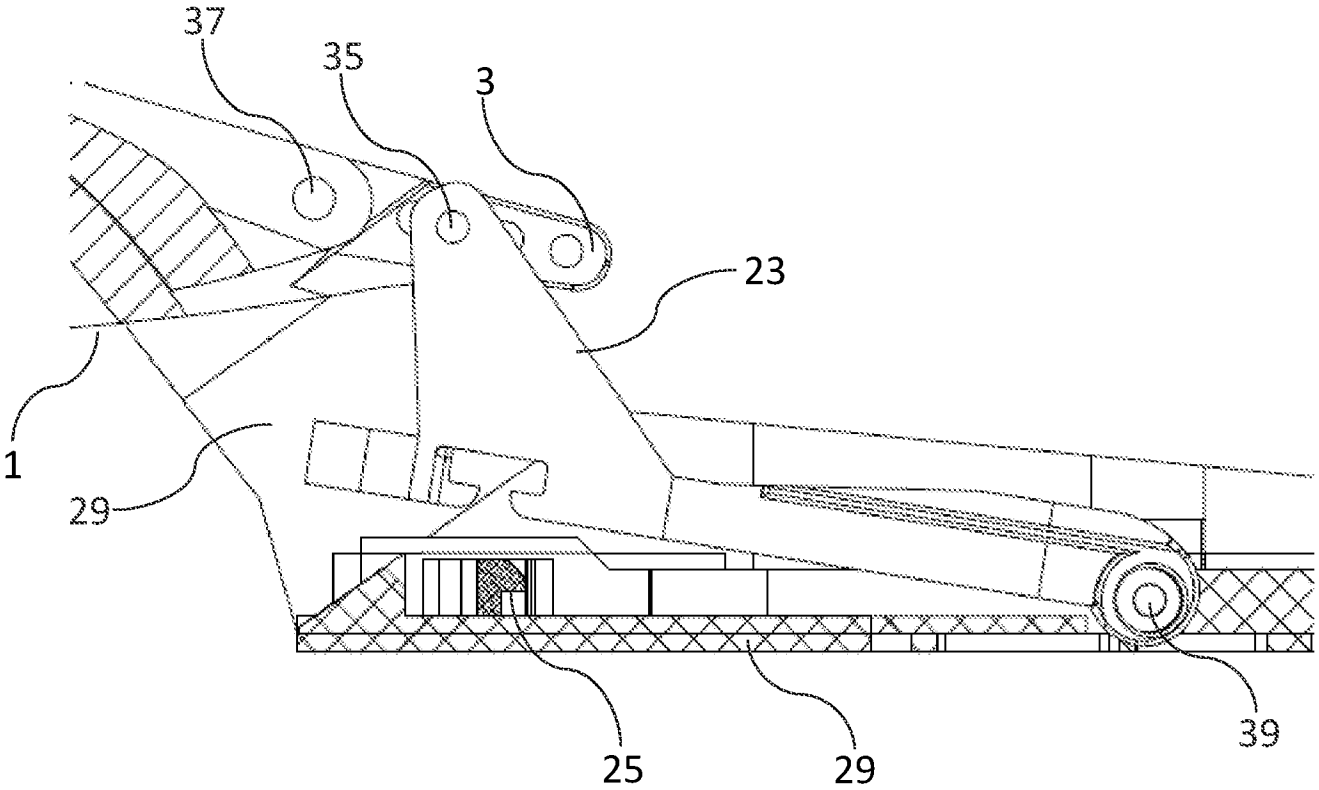
Figure 8C:
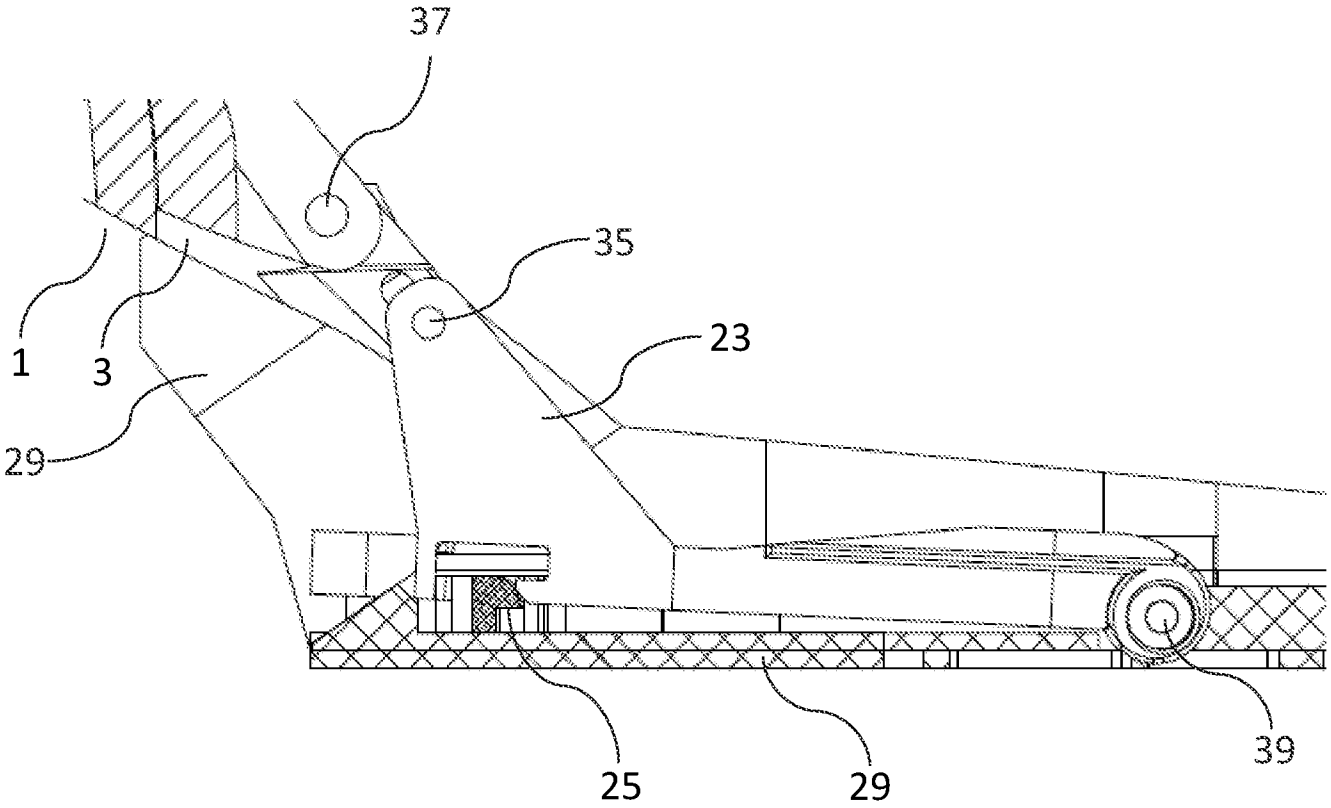
Figure 8D:
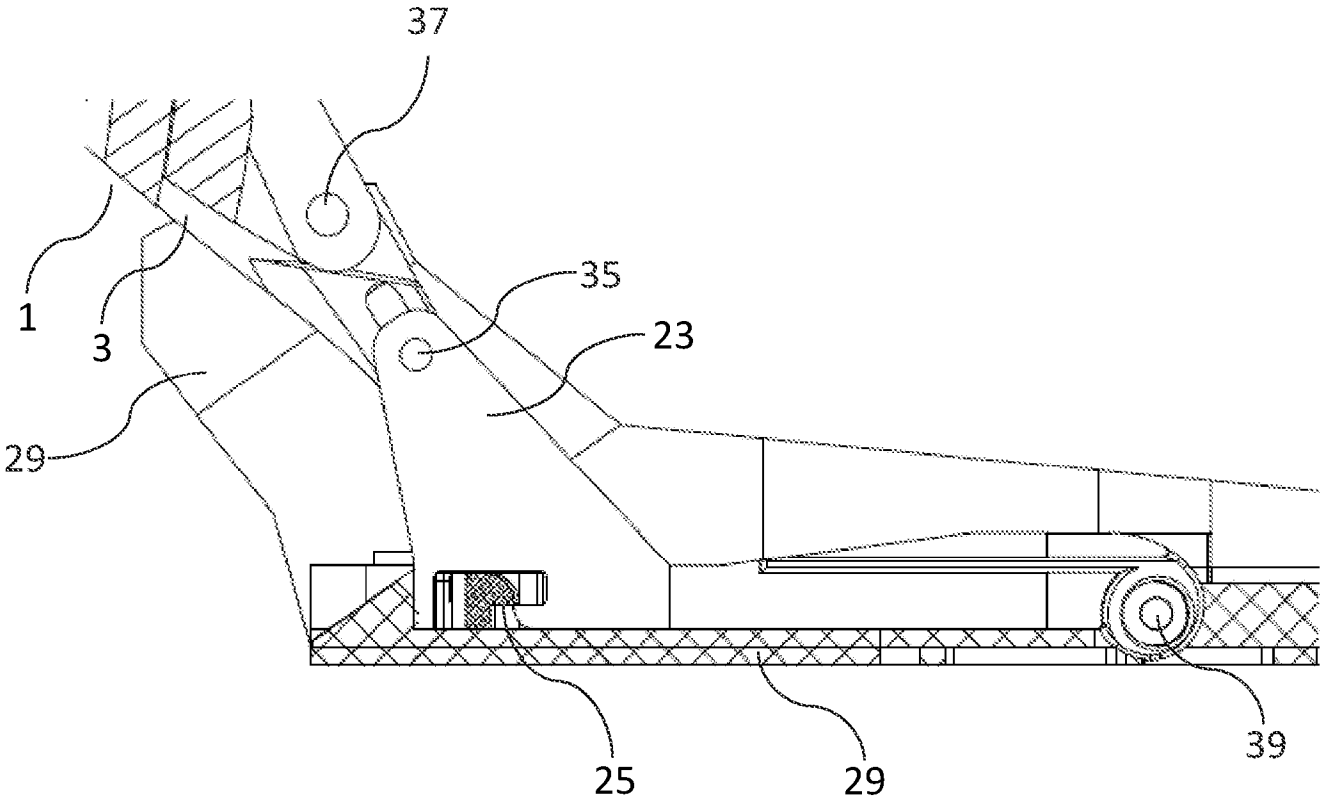
Figure 8E:
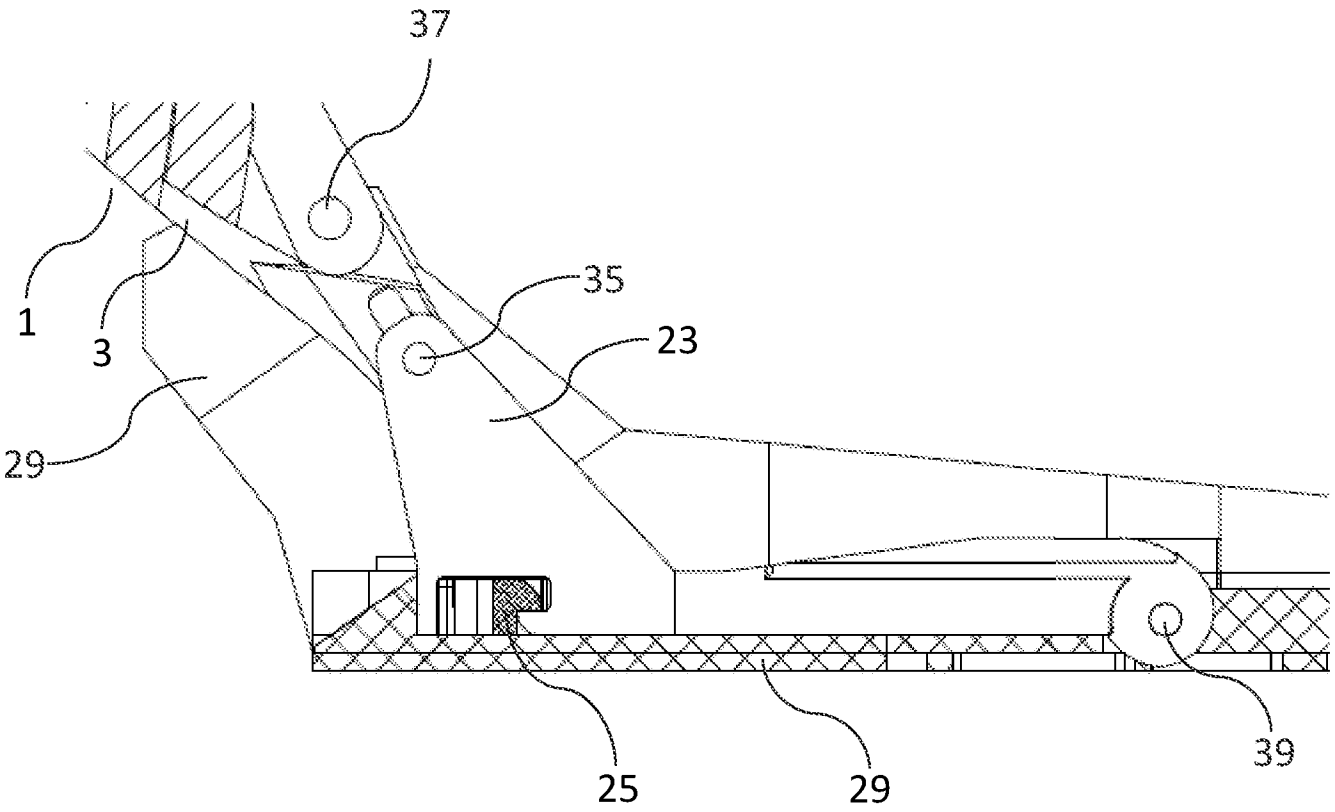

FIG. 8B depicts an embodiment in an unlocked system state in which heel plate 23, highback 1, and base plate 29 are able to move relative to one another. FIG. 8B further depicts locking bar 25 in an original position. From the unlocked system state, the heel plate 23 may rotate with respect to base plate 29 around pin joints 39 towards locking bar 25. The heel plate 23 may come into contact with the locking bar 25, as depicted in FIG. 8C. As further shown, the sections of the heel plate 23 and sliding bar 25 that come into contact with one another may be shaped to facilitate their relative motion during contact, such as by rounding or sloping. As the heel plate 23 continues its rotation toward the locking bar 25, the heel plate 23 can contact and influence the locking bar 25 to rotate with respect to the base plate 29 around pin joint 43, as described with reference to FIGS. 7A-7E. The rotation of locking bar 25 with respect to base plate 29 around pin joint 43 can be caused, aided, impeded, or otherwise affected by one of several apparatuses known in the art, such as compression springs embedded in base plate 29 opposing the motion caused by the currently described rotation of the heel plate 23. Heel plate 23 may further rotate so that a lip on the heel plate 23 passes a lip on the locking bar 25, as shown in FIG. 8D. After this point, the locking bar 25 can rotate with respect to the base plate 29 around pin joint 43 back toward its original position, as shown in FIG. 8E. This motion can be affected by compression springs embedded in base plate 29 or other apparatuses known in the art. The resultant overlap between the lips of heel plate 23 and locking bar 25 configures the system in a locked system state in which heel plate 23, highback 1, and base plate 29 are unable to move relative to one another.

The binding system may be configured so that the heel plate 23 contacts the base plate 29 at the point the latch is able to engage. This is shown in FIG. 8D as the point the lip on the heel plate 23 passes the lip on the locking bar 25. Alternatively, the binding system may be configured so that the latch is able to engage prior to the point at which the heel plate 23 would contact the base plate 29, which would allow the binding to enter the locked system state even if snow, ice, or debris were to accumulate between the base plate 29 and heel plate 23. In an embodiment, portions of the heel plate 23 and/or base plate 29 can comprise padding or other compressible material to improve the latch, provide comfort, and allow the binding to enter the locked, system state even if snow, ice, or debris were to accumulate between the base plate 29 and heel plate 23.

The binding system may also be configured to have sequentially placed latches, which would engage successively as the heel plate 23 rotates toward the base plate 29. This configuration would further allow for the accumulation of snow, ice, or debris between the base plate 29 and heel plate 23. With such accumulation, the heel plate 23 may not be pressed as closely to the base plate 29 as without. Further with such accumulation, only some of the latches may engage. However, as the snow, ice, or debris is dissipated, compacted, or removed, downward forces exerted, for example, by a snowboarder would cause further latches to engage and tighten the binding.

The system may be released from a locked system state into an unlocked system state by disengaging the latch. In the embodiment shown in FIG. 8, this may be done by rotating the locking bar 25 such that the lip of locking bar 25 no longer overlaps the lip of heel plate 23, as shown in FIG. 8D. This, motion can be caused, aided, impeded, or otherwise affected by one of several apparatuses known in the art. For example, the user can affect this motion of the locking bar, directly or indirectly, for example, through release lever 27. The release lever 27 and locking bar 25 may be connected using any direct or indirect connective apparatuses known in the art. According to the embodiment of FIGS. 8A-8E, disengaging the latch would trigger an unlocked system state in which the heel plate 23 may rotate around pin joints 39 away from locking bar 25. This would allow an opening between the base plate 29, highback 1, and heel strap 7 to increase and a boot 33 to be removed.

Figure 9A:
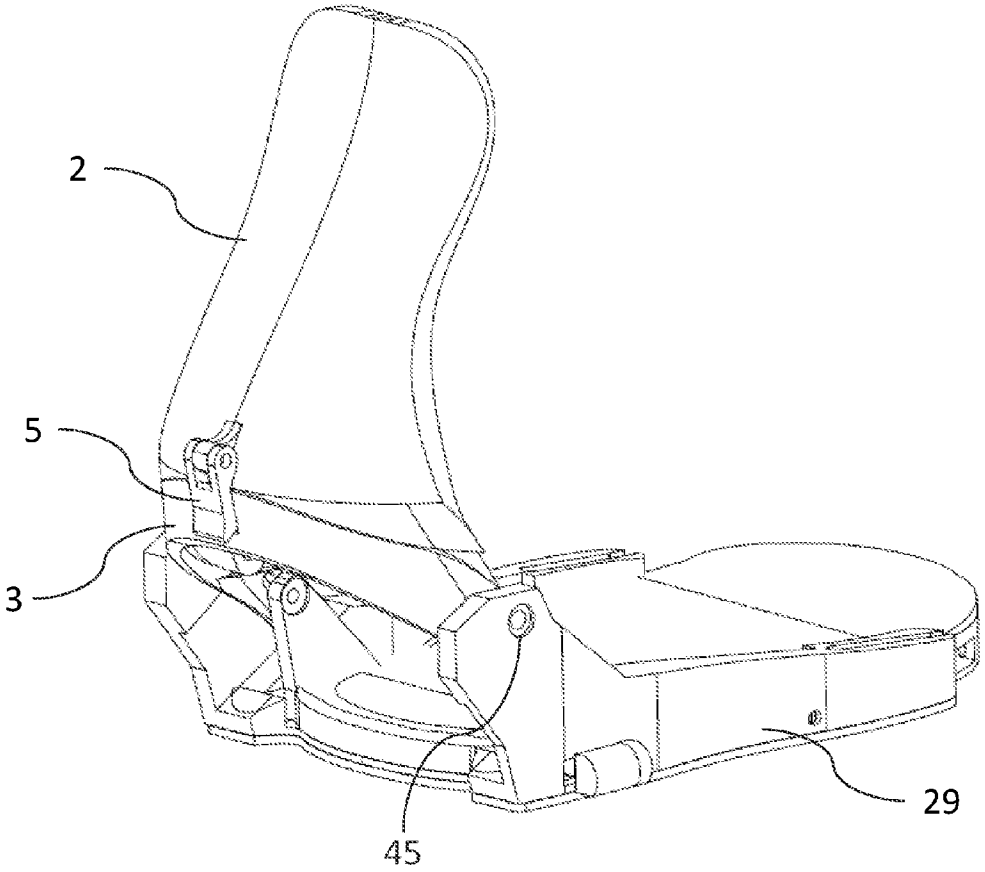
FIGS. 9A-9D depict an embodiment of a heel locking binding system in which portions of the system have been hidden.
Figure 9B:
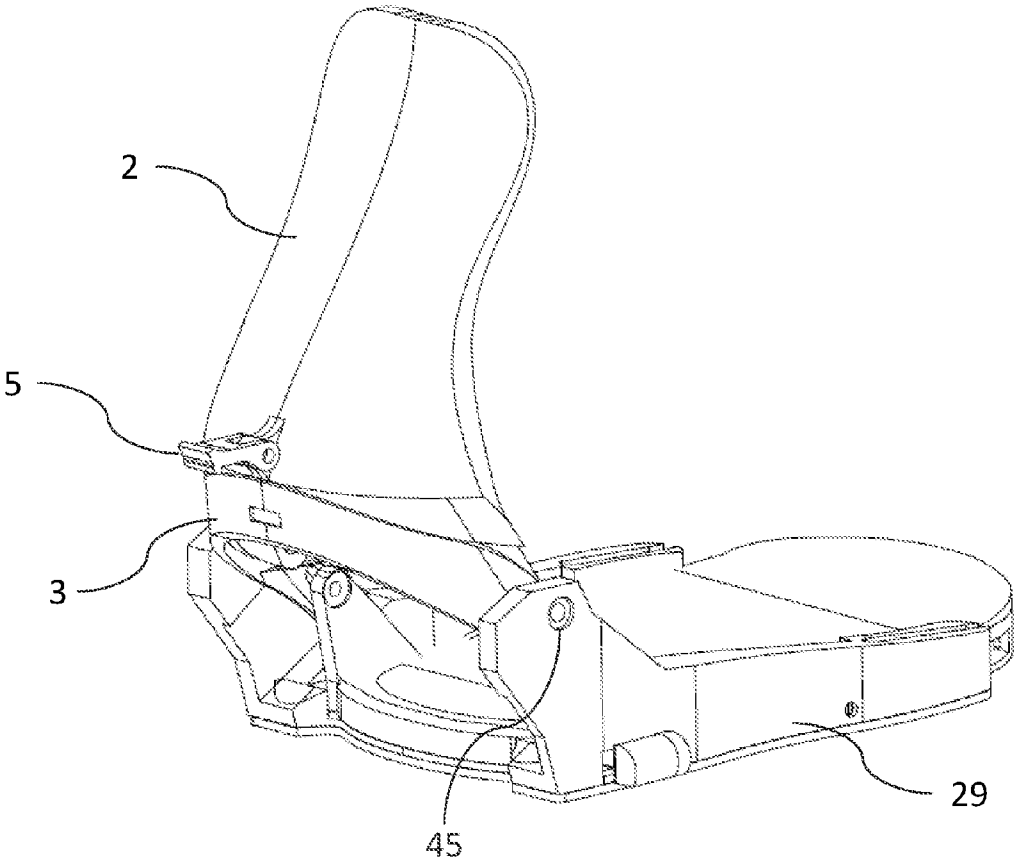
Figure 9C:
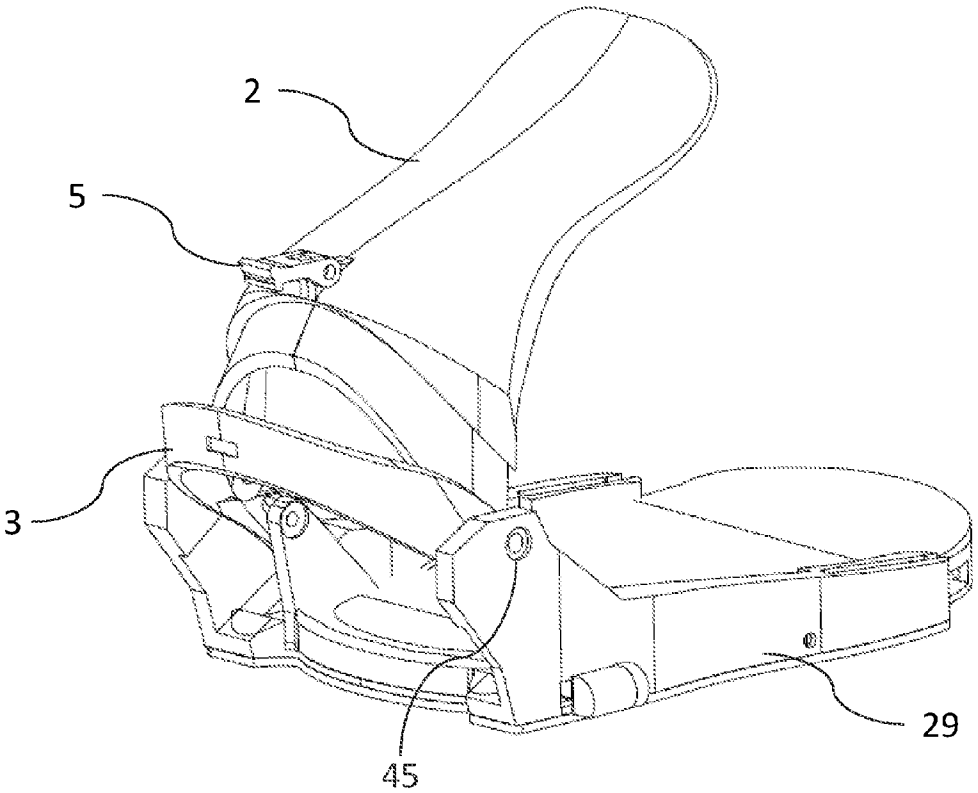
Figure 9D:
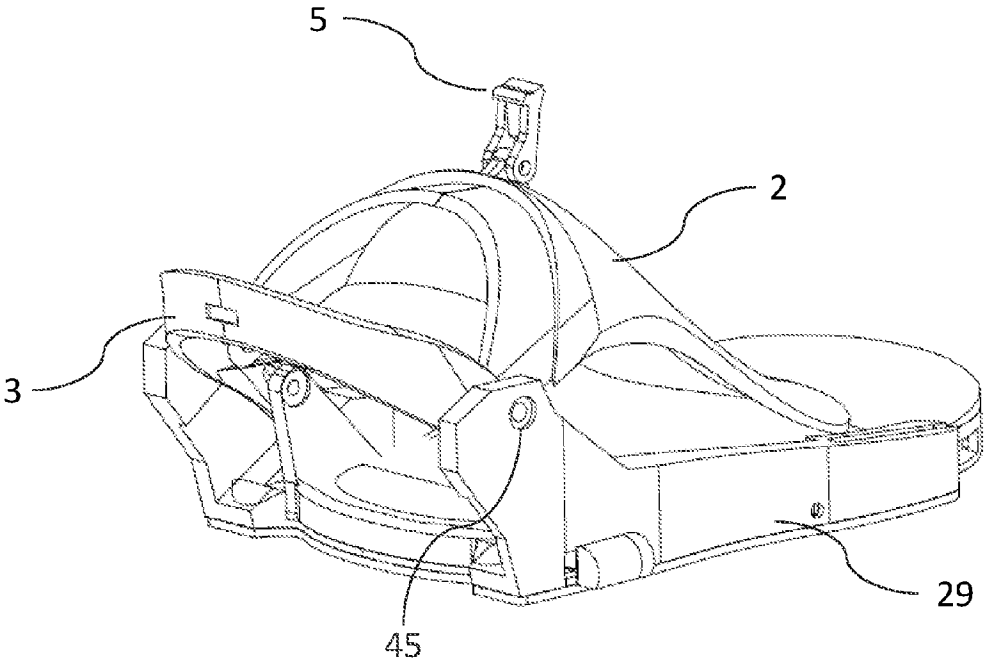

FIGS. 9A-9D depict an embodiment of a heel locking binding system in which portions of the system have been hidden. In the embodiment depicted in FIGS. 9A-9D, a binding system comprises a base plate 29, a highback first portion 2, and a highback second portion 3. In an embodiment, the highback first portion 2 is connected to the highback second portion 3 by pin joints 45. In FIGS. 9A-9D, pin joint 45 is coincident with pin joint 37, although that need not be the case. In an embodiment, the binding system may comprise a locked highback state in which the highback first portion 2 and highback second portion 3 are unable to move relative to one another. The binding system embodiment may alternatively comprise an unlocked highback state in which the highback first portion 2 and highback second portion 3 are able to move relative to one another. The binding system embodiment may be configured to enable the binding system to enter into, remain in, and be released from the locked highback state. FIG. 9A depicts an embodiment in the locked highback state. FIG. 9A further depicts an embodiment comprising a fastener 5. Fastener 5 is depicted as a clip in FIGS. 9A-9D. However, fastener 5 may take any form of joining parts known in the art, including but not limited to a bolt, screw, adhesive, pin, rope, staple, stitching, material, wrapping, button, grip, tape, magnet, or vacuum. In an embodiment, the binding system may enter into the locked highback state by engaging fastener 5 and may be released from the locked highback state by disengaging fastener 5. FIGS. 9B-9D depict an embodiment in the unlocked highback state. From the unlocked highback state, the highback first portion 2 may rotate with respect to highback second portion 3 around pin joints 45 towards base plate 29, as shown in FIGS. 9C and 9D. This motion can be caused, aided, impeded, or otherwise affected by one of several apparatuses known in the art. For example, the user can affect this motion or, for example, torsion springs may be connected to the highback first portion 2 and highback second portion 3 to influence rotation around the pin joints 45 connecting them. FIG. 9D depicts an embodiment in which the binding profile size has been reduced.

It will be understood by those skilled in the art that the pin joints 37, 39, 41, 43, and 45; pin-slot connections 35; and other connections described herein extend beyond the specifically disclosed embodiments to other alternative embodiments and equivalents thereof, including indirect and alternative connective apparatuses known in the art. It will also be understood by those skilled in the art that the relative motion described herein extends beyond the specifically disclosed embodiments to other alternative embodiments and equivalents thereof, including translation, rotation, kinematic chains, and other one-, two-, and three-dimensional motion known in the art. Further, although the embodiments are referenced herein with respect to connecting the right foot of a user to a snowboard, such reference is for ease of describing embodiments and is not meant to limit the disclosure to snowboarding technology or to limit the embodiments to being used on a certain foot.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments. The headings used herein are for the convenience of the reader only and are not meant to limit the scope of the inventions or claims.

Although the embodiments of the inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations of the inventions have been shown and illustrated in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments illustrated above.

What is claimed is:

1. A snowboard binding system for hands-free binding, the snowboard binding system comprising:

a base plate having a fore region, an aft region, a bottom surface configured to be positioned on a snowboard, and a contact surface opposite the bottom surface and configured to contact an underside of a boot of a user;

a highback portion having a first end region and a second end region, the first end region forming an angle with the second end region, the second end region of the highback portion rotatably connected to the aft region of the base plate;

a heel strap connected to the baseplate; and a heel plate having a fore region, an aft region, and a contact surface configured to contact the underside of the boot of the user, the fore region of the heel plate rotatably connected to the base plate, the aft region of the heel plate connected to the second end region of the highback portion by pin-slot connection, the heel plate moveable between a closed orientation in which the contact surface of the heel plate is substantially parallel to and substantially co-planar with the contact surface of the base plate, and an open orientation in which the aft region of the heel plate is rotated away from the bottom surface of the base plate;

the highback portion moveable between the closed orientation, wherein the first end region of the highback portion is substantially perpendicular to the contact surface of the heel plate, and the open orientation, wherein the first end region of the highback portion is substantially parallel to the contact surface of the heel plate;

wherein as the underside of the boot of the user contacts and applies downward forces on the contact surface of the heel plate, the heel plate and the highback portion rotate from the open orientation to the closed orientation.

2. The snowboard binding system of claim 1, wherein the heel plate and the highback portion rotate between the closed orientation and the open orientation without use of a cord.

3. The snowboard binding system of claim 2, further comprising:

a locked system state in which the base plate and the highback portion are unable to move relative to one another.

4. The snowboard binding system of claim 3, further comprising:

a locking bar having a medial region, a lateral region, and a center region, the center region of the locking bar rotatably connected to the base plate;

wherein the heel plate and the medial and lateral regions of the locking bar are configured to form a latch that can be engaged to trigger the locked system state or disengaged to trigger an unlocked system state in which the base plate and the highback portion are able to move relative to one another.

5. A snowboard binding system for hands-free binding, the snowboard binding system comprising:

a base plate having a fore region, an aft region, a bottom surface configured to be positioned on a snowboard, and a contact surface opposite the bottom surface and configured to contact an underside of a boot of a user;

a highback connected to the aft region of the base plate;

a heel strap having a connection point; and a heel plate having a fore region, an aft region, and a contact surface configured to contact the underside of the boot of the user, the fore region of the heel plate rotatably connected to the baseplate, the aft region of the heel plate connected to the connection point of the heel strap, the heel plate moveable between a closed orientation in which the contact surface of the heel plate is substantially parallel to and substantially co-planar with the contact surface of the base plate, and an open orientation in which the aft region of the heel plate is rotated away from the bottom surface of the base plate;

the heel strap moveable between the closed orientation, wherein the connection point of the heel strap is located a first distance above the bottom surface of the base plate, and the open orientation, wherein the connection point of the heel strap is located a second distance above the bottom surface of the base plate, the second distance being greater than the first distance;

wherein as the underside of the boot of the user contacts and applies downward forces on the contact surface of the heel plate, the heel plate and the heel strap rotate from the open orientation to the closed orientation.

6. The snowboard binding system of claim 5, wherein the heel plate and the heel strap rotate between the closed orientation and the open orientation without the use of a cord.

7. The snowboard binding system of claim 6, further comprising:

a semi-locked system state in which the base plate and the heel strap are unable to move relative to one another other than one degree of rotational freedom.

8. The snowboard binding system of claim 7, further comprising:

a locking bar having a medial region, a lateral region, and a center region, the center region of the locking bar rotatably connected to the base plate;

wherein the heel plate and the medial and lateral regions of the locking bar are configured to form a latch that can be engaged to trigger the semi-locked system state or disengaged to trigger an unlocked system state in which the base plate and the heel strap are able to move relative to one another in addition to one degree of rotational freedom.

9. The snowboard binding system of claim 6, further comprising:

a locked system state in which the base plate and the heel strap are unable to move relative to one another.

10. The snowboard binding system of claim 9, further comprising:

a locking bar having a medial region, a lateral region, and a center region, the center region of the locking bar rotatably connected to the base plate;

wherein the heel plate and the medial and lateral regions of the locking bar are configured to form a latch that can be engaged to trigger the locked system state or disengaged to trigger an unlocked system state in which the base plate and the heel strap are able to move relative to one another.

11. A snowboard binding system for hands-free binding, the snowboard binding system comprising:

a base plate having a fore region, an aft region, a bottom surface configured to be positioned on a snowboard, and a contact surface opposite the bottom surface and configured to contact an underside of a boot of a user;

a highback support having a first end region and a second end region, the first end region forming an angle with the second end region, the second end region of the highback support rotatably connected to the aft region of the base plate;

a heel strap having a connection point and connected to the second end region of the highback support at the connection point; and a heel plate having a fore region, an aft region, and a contact surface configured to contact the underside of the boot of the user, the fore region of the heel plate rotatably connected to the baseplate, the aft region of the heel plate connected to the second end region of the highback support by pin-slot connection, the heel plate moveable between a closed orientation in which the contact surface of the heel plate is substantially parallel to and substantially co-planar with the contact surface of the base plate, and an open orientation in which the aft region of the heel plate is rotated away from the bottom surface of the base plate;

the highback support moveable between the closed orientation, wherein the first end region of the highback support is substantially perpendicular to the contact surface of the heel plate, and the open orientation, wherein the first end region of the highback support is substantially parallel to the contact surface of the heel plate;

the heel strap moveable between the closed orientation, wherein the connection point of the heel strap is located a first distance above the bottom surface of the base plate, and the open orientation, wherein the connection point of the heel strap is located a second distance above the bottom surface of the base plate, the second distance being greater than the first distance;

wherein as the underside of the boot of the user contacts and applies downward forces on the contact surface of the heel plate, the heel plate, the highback support, and the heel strap rotate from the open orientation to the closed orientation.

12. The snowboard binding system of claim 11, wherein the heel plate, the highback support, and the heel strap rotate between the closed orientation and the open orientation without the use of a cord.

13. The snowboard binding system of claim 12, further comprising:

a locked system state in which the base plate and the highback support are unable to move relative to one another.

14. The snowboard binding system of claim 13, further comprising:

a locking bar having a medial region, a lateral region, and a center region, the center region of the locking bar rotatably connected to the base plate;

wherein the heel plate and the medial and lateral regions of the locking bar are configured to form a latch that can be engaged to trigger the locked system state or disengaged to trigger an unlocked system state in which the base plate and the highback support are able to move relative to one another.

15. The snowboard binding system of claim 11, wherein:

the highback support comprises a highback first portion and a highback second portion;

wherein the highback first portion and the highback second portion are able to move relative to one another.

16. The snowboard binding system of claim 15, further comprising:

a locked highback state in which the highback first portion and highback second portion are unable to move relative to one another.

17. The snowboard binding system of claim 16, further comprising:

a fastener that can be engaged to trigger the locked highback state or disengaged to trigger an unlocked highback state in which the first portion and second portion are able to move relative to one another.

* * * * *